United States Patent [19]

Shimono

[11] 4,070,881

[45] Jan. 31, 1978

[54] PUSHBUTTON OPERATED DOOR LOCKS

[76] Inventor: Junichi Shimono, 913 Enjoji, Kasamatsu-cho, Hashima, Gifu, Japan, 501-61

[21] Appl. No.: 750,563

[22] Filed: Dec. 14, 1976

[51] Int. Cl.[2] ..... E05B 37/02; E05B 37/16

[52] U.S. Cl. ..... 70/315

[58] Field of Search ..... 70/313, 314, 315, 316, 70/317, 318, 323, 327

[56] References Cited

U.S. PATENT DOCUMENTS

| | | | |
|---|---|---|---|
| 200,070 | 2/1878 | Lock | 70/317 |
| 745,081 | 11/1903 | Smith | 70/314 X |
| 1,144,887 | 6/1915 | Besharov | 70/316 X |
| 1,156,741 | 10/1915 | Besharov | 70/317 |
| 2,856,765 | 10/1958 | Sreb | 70/323 X |
| 3,379,040 | 4/1968 | Shimono | 70/313 |

*Primary Examiner*—Roy D. Frazier
*Assistant Examiner*—Thomas J. Holko
*Attorney, Agent, or Firm*—Andrew R. Basile

[57] ABSTRACT

Disclosed is a pushbutton operated door lock particularly featured by easy selection and changeability of a code number inputted into the door lock for its unlocking operation. The door lock includes a plurality of tumbler rings rotatably supported on a lock shaft in a casing. A lock bolt having a plurality of notches along its length is slidably supported on the lock shaft. Each of the tumbler rings is formed with a plurality of lateral bores. An engage pin is reciprocatorily movably received in each lateral bore of each tumbler ring. A plurality of pushbuttons are each connected with one of the tumbler rings to rotate them individually. Other pushbuttons are operationally associated with the tumbler rings to rotate all of them simultaneously. The tumbler rings are engageable with the notches on the lock bolt when they are rotated. A wall portion of the casing is formed therethrough with a plurality of apertures through each of which a pusher rod can be inserted to work on the engage pin in the corresponding one of the lateral bores of one of the tumbler rings for the reciprocatory movement of the engage pin.

6 Claims, 69 Drawing Figures

PUSHBUTTON OPERATED DOOR LOCKS

This invention relates to a pushbutton operated door lock.

The inventor of this invention has previously developed a pushbutton operated door lock which can be opened and closed with a high degree of surety and reliability by simple pushbutton operation either on the inside or outside of a door on which the lock is mounted. There are also known other mechanical pushbutton operated door locks that can be opened and closed by simple pushbutton operation indoors or outdoors. These known mechanical door locks are, however, unsatisfactory, because after they are assembled, it is difficult to change a code number formulated by a certain group of pushbuttons for opening the lock when those pushbuttons are depressed. There are known electrical pushbutton operated door locks which have overcome the aforementioned difficulty, but the electrical door locks are unsatisfactory because of their entire uselessness during power or battery failure. Thus, mechanical door locks are by far more suitable, but any known mechanical pushbutton operated door lock that can be opened and closed by simple pushbutton operation either on the inside or outside of a door presents difficulty in code number changing, or at best permits such code number changing only on the outdoor side.

It is, therefore, an object of this invention to eliminate all of the aforementioned drawbacks of the pushbutton operated door locks known in the art and provide an ideally improved mechanical pushbutton operated door lock which is not merely capable of being opened and closed by simple pushbutton operation either on the inside or outside of a door on which it is mounted, but also permits free and easy selection and changing of a code number inputted into the door lock for its opening or unlocking operation, not to speak of its usefulness for crime prevention.

According to this invention, there is provided a pushbutton operated door lock essentially comprising: a casing; a lock shaft in the casing; a lock bolt slidably supported on the lock shaft and having a plurality of notches; a plurality of tumbler rings rotatably supported on the lock shaft and each having an outer peripheral edge formed with a plurality of lateral bores; an engage pin having one end received in each of the lateral bores of each of the tumbler rings and reciprocatorily movable along the lateral bore for restricting an angle of rotation of the tumbler ring; a plurality of pushbuttons on the casing adapted to rotate the tumbler rings individually; a plurality of pushbuttons on the casing adapted to rotate all of the tumbler rings simultaneously; the casing having a wall formed with a plurality of apertures each providing access to the engage pin in any of the lateral bores of one of the tubular rings for the reciprocatory movement of the engage pin for restricting the angle of rotation of the tumbler ring on the outside of the casing; and each of the notches on the lock bolt being engageable with one of the tumbler rings upon rotation of the tumbler ring.

The door lock of this invention is very easy to handle either on the indoor or outdoor side of a door for its sure opening and closing operation. The function of the pushbuttons provided for rotating the tumbler rings individually can be changed freely and easily. A desired number of pushbuttons may be selected to formulate a code number to be inputted into the door lock for the unlocking operation, while the remaining pushbuttons are left in their inoperative position in which they do not in any way take part in the unlocking operation. Any of the pushbuttons may be selected more than once for taking part in the formulation of the code number or the unlocking operation. For example, one or more of the pushbuttons may be used twice in the formulation of a particular code number, so that the door lock can be opened only when those particular pushbuttons are depressed twice. All of these pushbuttons are identical in appearance, and produce an identical sound or finger touch, whichever of the pushbuttons may be depressed and how many times they may be depressed. Therefore, it is impossible for any third person to know which pushbuttons should be depressed to open the door lock, or whether they should be depressed once or twice. Thus, the door lock of this invention works excellently for crime prevention.

A most significant feature of this invention resides in the free changeability of the code number inputted into the door lock for its unlocking operation. This is quite easily possible whenever and as many times as desired, by changing the angular position of any tumbler rings involved as appropriate and the position of the associated engage pins relative to the lateral bores of the tumbler rings by manipulation through the apertures in the casing wall. For this purpose, the door lock of this invention further includes a number of pusher or guide rods adapted for selective insertion through the apertures in the casing wall to abut on the adjacent engage pins and effect reciprocatory movement thereof.

The door lock of this invention do advantageously not require for its operation a key of any sort which has hitherto been a source of trouble with a conventional door lock, since a key is easily lost or misplaced and necessitates utmost care in its safe custody.

The foregoing and other objects, features and advantages of this invention will become apparent from the following detailed description of a preferred embodiment thereof and the accompanying drawings, in which.

This invention will now be described in further detail by way of a preferred embodiment thereof as shown in the accompanying drawings. It is, however, to be expressly understood that the drawings and the following detailed description with reference thereto are merely intended for illustration and never for limitation or definition of the scope of this invention.

Figure 37:
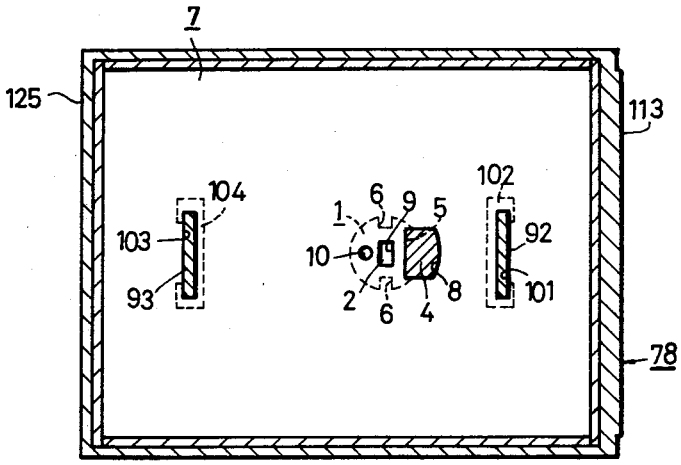
FIG. 37 is a vertical sectional view taken along the line XXXVII—XXXVII of FIG. 6.
Figure 39:
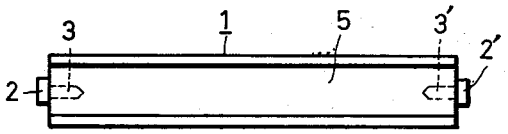
FIG. 39 is a front elevational view of the lock shaft.
Figure 40:
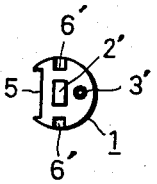
FIG. 40 is a side elevational view of the lock shaft.
Figure 41:
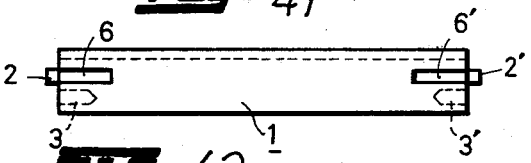
FIG. 41 is a bottom plan view of the lock shaft.

Referring to the drawings more particularly, reference numeral 1 indicates a generally solid cylindrical lock shaft formed at each end with a projection 2, 2' and a tapped hole 3, 3' as shown in FIGS. 39 through 41. The lock shaft 1 is provided on its peripheral surface with a guide groove 5 extending along its entire length and adapted to receive a lock bolt 4. The peripheral surface of the lock shaft 1 is further provided with two pairs of diametrically opposite slots 6, 6', one of which pairs is located at each end of the lock shaft 1. Numeral 7 indicates a vertically disposed rectangular end plate formed therethrough with a guide opening 8 located somewhat to the right of the center of the end plate 7 and adapted for receiving the lock bolt 4. The end plate 7 is further provided with two apertures 9 and 10 in the vicinity of the guide opening 8 in horizontally aligned relationship therewith. The apertures 9 and 10 are alignable with the projection 2 and the tapped hole 3, respectively, of the lock shaft 1. The end plate 7 is best shown in FIG. 37.

Figure 38:
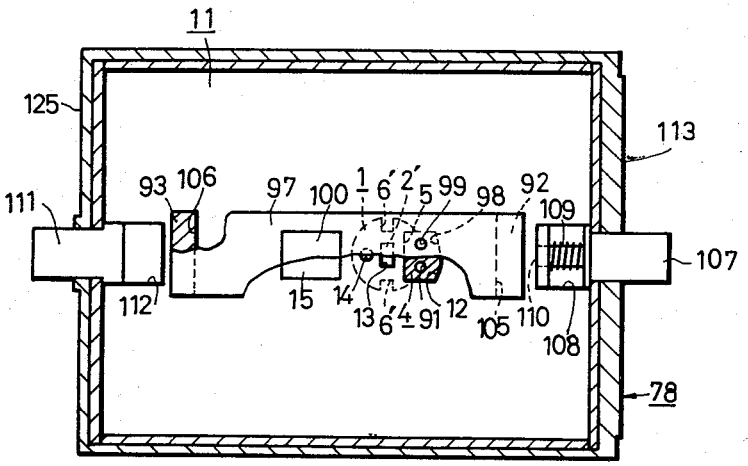
FIG. 38 is a vertical sectional view taken along the line XXXVIII—XXXVIII of FIG. 6.

Another end plate 11 is substantially of the identical shape and size to the end plate 7 and is adapted for location opposite thereto. The end plate 11 is likewise provided with a guide opening 12 adapted for receiving the lock bolt 4 and two apertures 13 and 14 alignable with the projection 2' and the tapped hole 3', respectively, of the lock shaft 1 as shown in FIG. 38. The guide opening 12 is alignable with the guide opening 8 of the end plate 7 and the apertures 13 and 14 with the apertures 9 and 10, respectively, of the end plate 7. A piece of iron 15 for the purpose of magnetic attraction is secured to the end plate 11 somewhat to the left of the aperture 14.

Figure 56:
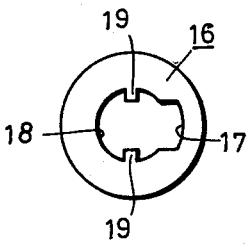
FIGS. 56 through 58 are side elevational views of three washers, respectively.

As shown in FIG. 56, a circular washer 16 is provided with a generally circular hole 18 in its center for insertion of the lock shaft 1. The hole 18 is enlarged along a portion of its circumference to define a recessed opening 17 which is alignable with the guide opening 8 in the end plate 7. The washer 16 is further formed with a pair of diametrically opposite projections 19 radially inwardly projecting from the edge of the hole 18 and engageable with the slots 6 on the lock shaft 1.

Figure 57:
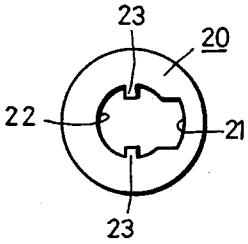

FIG. 57 shows a circular washer 20 which is of the identical shape and size to the washer 16 except in thickness. The door lock of this invention employs a couple of such washers 20. The washer 20 is likewise provided with a central hole 22, a recessed opening 21 and a pair of radially inwardly extending projections 23.

Figure 58:
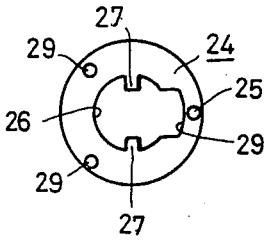
Figure 59:
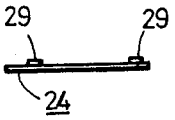
FIG. 59 is a bottom plan view of the washer shown in FIG. 58.
Figure 60:
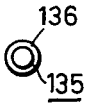
FIG. 60 is a front elevational view of one of a pair of guide rods.
Figure 61:
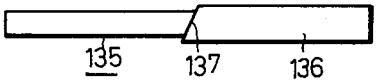
FIG. 61 is a side elevational view of the guide rod of FIG. 60.
Figure 62:
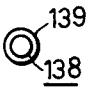
FIG. 62 is a front elevational view of the other guide rod.
Figure 63:
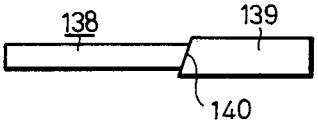
FIG. 63 is a side elevational view of the guide rod of FIG. 62.

The door lock of this invention includes a further circular washer 24 which is of the identical shape and size to the washer 20 and which is likewise provided with a central hole 26, a recessed opening 25 and a pair of radially inwardly extending projections 27 as shown in FIG. 58. The washer 24 is formed on one side thereof with three spacer projections 29 which are generally equally spaced from one another along the outer circumference of the washer 24 as shown in FIGS. 58 and 59. As will hereinafter be described in further detail, the washer 24 is positioned adjacent to a tumbler ring 28 and the spacer projections 29 serve to maintain the tumbler ring 28 in adequately spaced relationship from the washer 24 and minimize frictional resistance of the washer 24 to the tumbler ring 28 during rotation of the latter.

Figure 46:
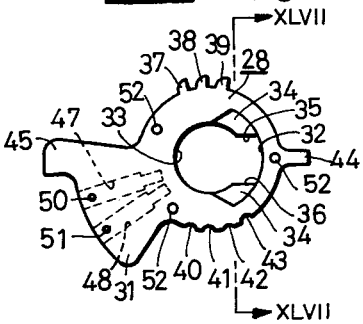
FIG. 46 is a side elevational view of the tumbler ring.
Figure 47:
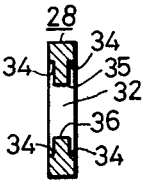
FIG. 47 is a vertical sectional view taken along the line XLVII—XLVII of FIG. 46.

The door lock of this invention includes five tumbler rings 28, each of which has a circular body of substantially the identical size to the washer 24 and includes an extension 31 radially outwardly projecting from a portion of the outer circumference of the circular body as shown in FIG. 46. The radial extension 31 is provided with a pair of elongate bores 47 and 48 extending radially relative to the circular body and adapted to receive an engage pin 30 as will hereinafter be described in further detail. The circular body of the tumbler ring 28 has a circular hole 33 in its center for insertion of the lock shaft 1. The central hole 33 is enlarged along a part of its edge to define a radially outwardly extending recessed opening 34 which is alignable with the guide opening 8 of the end plate 7. The tumbler ring 28 is reduced in thickness at 34 on each side thereof as best shown in FIG. 47, whereby a pair of arcuately shaped tongues 35 and 36 are defined around the hole 33 with the recessed opening 32 in between. Each of the tongues 35 and 36 has an inner arcuate edge terminating at the edge of the hole 33 and an outer arcuate edge circumscribing the outer limit of the recessed opening 32 as best shown in FIG. 46. The tongues 35 and 36 have an equal arcuate length which is slightly greater than the angular distance by which the recessed opening 32 is displaced upon rotation of the tumbler ring 28 in either direction about its own axis over a distance twice as large as a predetermined angle. The tongues 35 and 36 are engageable with notches formed in the lock bolt 4 as will hereinafter be described in further detail.

The tumbler ring 28 further includes three teeth or ratchets 37, 38 and 39 which are equally spaced from one another and radially outwardly project from the outer circumference of the circular body defining the tumbler ring 28. The central ratchet 38 lies on a diametrical centerline of the circular body which is perpendicular to the radial centerline of the recessed opening 32. The other ratchets 37 and 39 are somewhat spaced from the central ratchet 38 in opposite directions along the outer edge of the circular body. The tumbler ring 28 further includes four equally spaced, semicircular recesses 40, 41, 42 and 43 formed along an outer edge portion of the circular body which is diametrically opposite to that edge portion from which the ratchets 37, 38 and 39 project. The recess 41 lies on the centerline on which the ratchet 38 is positioned, and the recess 42 and 43 are spaced from the recess 41 in a circumferential direction opposite to that in which the recess 40 is spaced from the recess 41, as illustrated in FIG. 46. The tumbler ring 28 is provided with a radially outwardly projecting finger 44 lying on an extension of the radial centerline of the recessed opening 32 as shown at right in FIG. 46. Another finger 45, which is diametrically opposite to the finger 44, radially outwardly projects from the circular body as shown at left in FIG. 46, and is integral with, and further projects beyond, the outer extremity of the extension 31. The bores 47 and 48 are circumferentially spaced from the finger 45 and are each adapted to receive at its bottom a spring 46 which urges the engage pin 30 radially outwardly.

Figure 45:
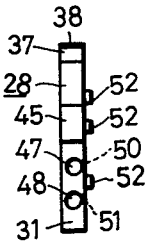
FIG. 45 is a rear elevational view of a tumbler ring.

The extension 31 of the tumbler ring 28 is further provided with a pair of angularly spaced apertures 50 and 51 formed somewhat inwardly of the outer extremity of the extension 31 and each having a longitudinal axis aligned with the longitudinal axis of one of the lateral bores 47 and 48 as is obvious from FIGS. 45 and 46. The apertures 50 and 51 open into the lateral bores 47 and 48, respectively, and are each adapted to receive a pin 49 adapted to restrict the movement of the engage pin 30 as will hereinafter be described in further detail. The tumbler ring 28 further includes three spacer projections 52 formed on one surface of its circular body and located somewhat inwardly of the outer circumference of the circular body as shown in FIG. 46. The spacer projections 52 are generally equally spaced from one another and provide means for maintaining an adequate spacing between the tumbler ring 28 and another tumbler ring 28′ which is placed in alternating relation to the tumbler ring 28 as will hereinafter be described in further detail, and for minimizing frictional contact between the tumbler rings 28 and 28′ during their individual rotation relative to each other.

Figure 64:
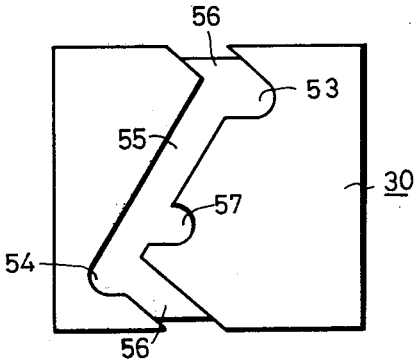
FIG. 64 is an exploded view of an engage pin.
Figure 65:
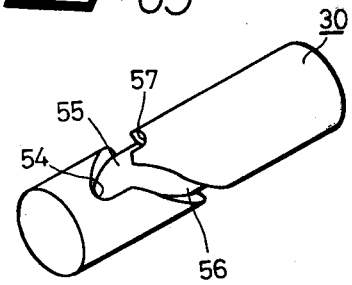
FIG. 65 is a perspective view of the engage pin shown in FIG. 64.

Referring to FIG. 65, the engage pin 30 is of the solid cylindrical construction. The door lock of this invention employs twenty engage pins 30 of the identical construction. The engage pin 30 is formed with a first recess 53 in its circumferential surface as shown toward the right-hand side of FIG. 64. The engage pin 30 is also provided with a second recess 54 which is spaced from the first recess 53 around the circumference of the engage pin 30 by an angular distance equal to about two-thirds of the circumference of the engage pin 30. The second recess 54 is offset toward the left-hand end of the engage pin 30 as shown in FIG. 64. The first and second recesses 53 and 54 are connected with each other by an oblique guide groove 55 which is adapted to receive a stop pin 49 and permit its free movement therealong whenever necessary. The recesses 53 and 54 are further connected with each other on the opposite side of the engage pin 30 from the groove 55 by a second oblique guide groove 56 which is inclined relative to the longitudinal axis of the engage pin 30 at a steeper angle than the first guide groove 55 is, as can be seen from FIG. 64. The engage pin 30 is further formed with a third recess 57 opening into the first guide groove 55 and located closer to the second recess 54 than to the first recess 53 as shown in FIG. 64. The third recess 57 is adapted to releasably receive the stop pin 49 as will hereinafter be described in further detail.

Figure 66:
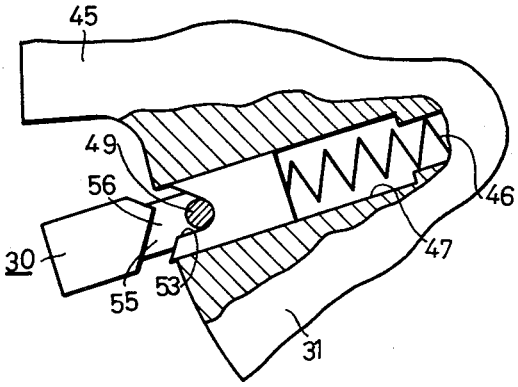
FIG. 66 is a side elevational view of one engage pin shown with a fragmentary illustration of the associated tumbler ring.
Figure 67:
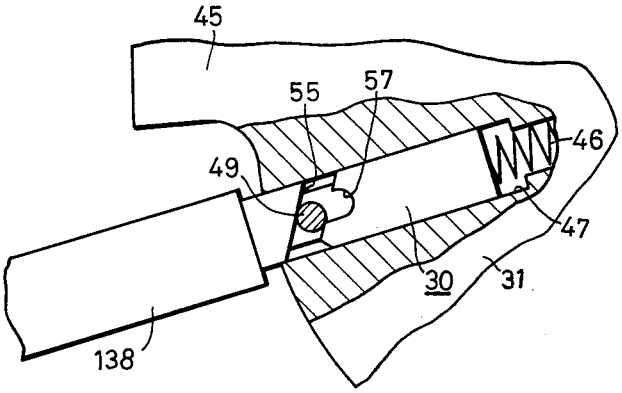
FIG. 67 is a view similar to FIG. 66, but showing the engage pin in a different position relative to the tumbler ring.
Figure 68:
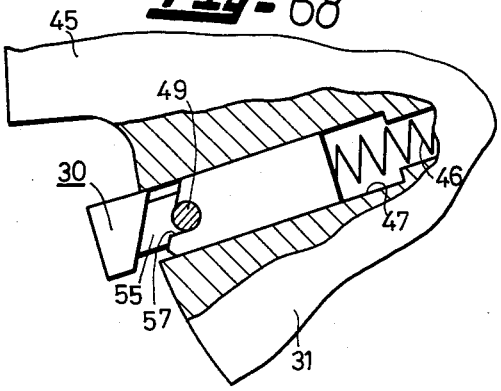
FIG. 68 is a view similar to FIG. 67, but showing the engage pin in a different position relative to the tumbler ring.
Figure 69:
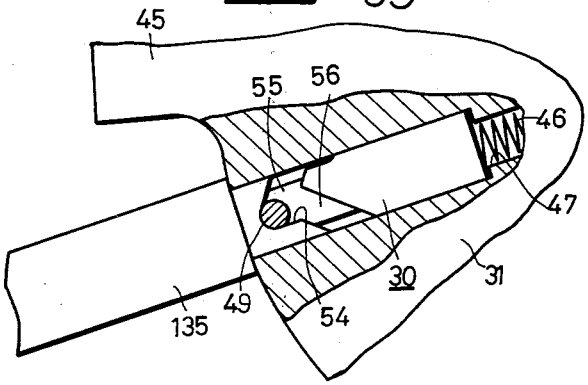
FIG. 69 is a view similar to FIG. 68, but showing the engage pin in a different position relative to the tumbler ring.

When the engage pin 30 is inserted into the lateral bore 47 or 48 of the tumbler ring 28 with its inner end resting against a spring 46 located at the bottom of the lateral bore 47, and held to the tumbler ring 28 by a stop pin 49 extending through the aperture 50 into the first recess 53, each engage pin 30 is concealed in the lateral bore 47 or 48 along about a half of its length, while the remaining half exposes itself beyond the outer limit of the extension 31 of the tumbler ring 28, as illustrated in FIG. 66. It will, thus, be observed that in its position shown in FIG. 66, the engage pin 30 will find its outer extremity circumscribing the outer extremity of the finger 45, so that the engage pin 30 can functionally take the place of the finger 45, whenever appropriate. Application to the engage pin 30 of an external force directed toward the center of the tumbler ring 28 results in rotation and inward axial displacement of the engage pin 30 against the action of the spring 46 as it is guided by the stop pin 49 which leaves the first recess 53 and slides along the first groove 55, whereby the engage pin 30 is eventually totally concealed in the lateral bore 47 upon receipt of the stop pin 49 in the second recess 54 as shown in FIG. 69. The first and second recesses 53 and 54 and the first and second guide grooves 55 and 56 are so related to one another that upon interruption of such external force application, the normal action of the spring 46 causes the stop pin 49 to displace itself relative to the engage pin 30 in such a manner that the stop pin 49 leaves the second recess 54 and moves back into the first recess 53 through the second guide groove 56 to expose about a half of the length of the engage pin 30 out of the extension 31 as shown in FIG. 66. If such force application to the engage pin 30 is interrupted somewhat earlier, namely, prior to complete withdrawal of the engage pin 30 into the lateral bore 47 when the stop pin 49 stays in front of the third recess 57 and slightly forward of a horizontal centerline of the third recess 57 (as viewed in FIG. 64) as illustrated in FIG. 67, the spring 46 urges the engage pin 30 outwardly and the engage pin 30 rotates in a reverse direction to allow the stop pin 49 to move back relative to the engage pin 30 along the first guide groove 55 and slip into the third recess 57, whereby the engage pin 30 is held in position as shown in FIG. 68. In the position shown in FIG. 68, the engage pin 30 is concealed in the lateral bore 47 along the major part of its length and only a minor lengthwise portion of the engage pin 30 is exposed. In this position of the engage pin 30, further application of an external force axially to the exposed end of the engage pin 30 causes displacement of the stop pin 49 from the third recess 57 into the second recess 54, whereupon the engage pin 30 is totally withdrawn into the lateral bore 47 as described with reference to FIG. 69. In the position shown in FIG. 69, interruption of the force application results in rotation of the engage pin 30 along the second guide groove 56 under the action of the spring 46 with relative displacement of the stop pin 49 from the second recess 54 to the first recess 53, whereupon about a half lengthwise portion of the engage pin 30 is exposed out of the lateral bore 47 and its outer end circumscribes the outer extremity of the adjacent finger 45 as shown in FIG. 66 to permit the engage pin 30 to functionally take the place of the finger 45.

Figure 10:
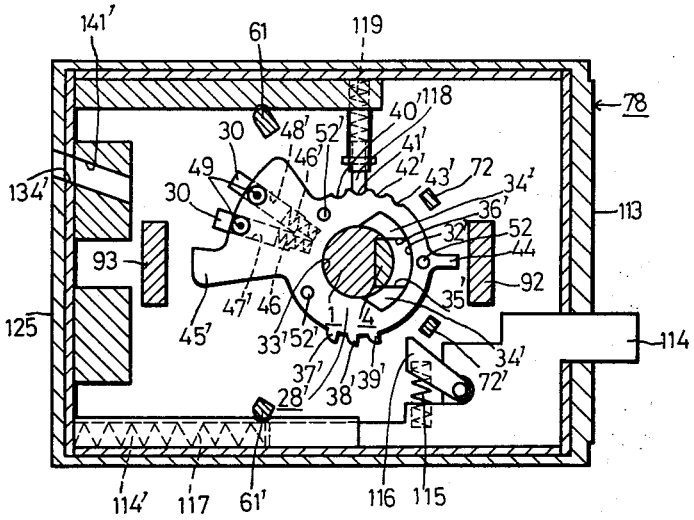
FIG. 10 is a vertical sectional view taken along the line X—X of FIG. 1.

The tumbler ring 28′ is of the identical size and construction to the tumbler ring 28 except that the positions of the ratchets, circumferential recesses and lateral extension are inverted in the tumbler ring 28′ as is obvious from the showing of FIG. 10. The door lock of this invention is provided with five such tumbler rings 28′. Each tumbler ring 28′ includes a circular body having a circular hole 33′ in its center for insertion of the lock shaft 1 and a laterally recessed guide opening 32′ alignable with the guide opening 8 of the end plate 7. The tumbler ring 28′ includes a series of circumferentially spaced ratchets 37′, 38′ and 39′ provided in a position turned 180° around the ring from the position of their counterparts shown, for example, in FIG. 46. Likewise, a series of semi-circular recesses 40′, 41′, 42′ and 43′ are located in a position turned 180° from the position of their counterparts on the tumbler ring 28. The tumbler ring 28′ of FIG. 10 includes a relatively wide lateral extension 31′ positioned symmetrically to its counterpart on the tumbler ring 28 of FIG. 46 with respect to a centerline passing through the center of the circular hole 33 and the longitudinal axis of the finger 44. A second finger 45′ is integral with the lateral extension 31′ and radially outwardly extends along the centerline mentioned in the immediately preceding sentence. Numerals 34′, 35′, 36′, 44′, 47′, 48′, 50′, 51′ and 52′ are substantially of the identical construction or configuration to their counterparts shown at 34, 35, 36, 44, 47, 48, 50, 51 and 52, respectively, in FIG. 46. They are all functionally similar to their counterparts on the tumbler ring 28 of FIG. 46. No further explanation would be necessary to any person of ordinary skill in the art.

Figure 48:
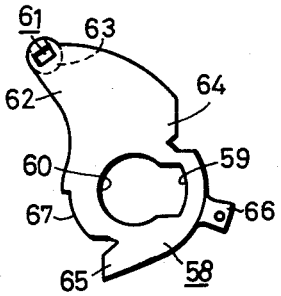
FIG. 48 is a side elevational view of one of a pair of locking rings.
Figure 49:
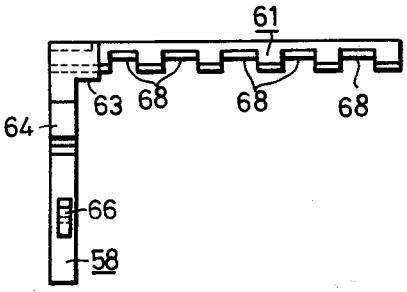
FIG. 49 is a front elevational view of the locking ring of FIG. 48 shown with a driving rod.

FIG. 48 shows a driving ring 58 for the locking purpose having a circular hole 60 for insertion of the lock shaft 1 and a radially outwardly recessed opening 59 alignable with the guide opening 8 of the end plate 7. The locking ring 58 includes an enlarged lateral extension defining a driving lever 62 having a free end to which a driving rod 61 is secured. The driving rod 61 is so positioned relative to the locking ring 58 that the driving rod 61 is spaced from the finger 45′ of the tumbler ring 28′ by an angular distance equal to three times as large as a predetermined angle when the locking ring 58 is placed alongside of the tumbler ring 28′ with the former's recessed opening 59 and central hole 60 aligned with the latter's recessed opening 32′ and central hole 33′, respectively. The driving lever 62 is formed at its free end with an increased thickness portion 63 to which the driving rod 62 is rigidly connected as shown in FIG. 49. The locking ring 58 is further formed with a radially extending ratchet 64 so positioned relative to the locking ring 58 that the locking ring 58 may be rotated by an angular distance equal to three times as large as a predetermined angle when force is applied to the ratchet 64 in a counterclockwise direction. Another radially projecting ratchet 65 is formed diametrically opposite to the ratchet 64 and so positioned that the locking ring 58 may be rotated by an angular distance equal to three times as large as a predetermined angle when force is applied to the ratchet 65 in a counterclockwise direction. A radially projecting lug 66 is provided in a circumferential position between the two ratchets 64 and 65 and is adapted for connection with a spring as will hereinafter be described in further detail. The locking ring 58 is further formed with a circumferential recess 67 in a position generally diametrically opposite to the lug 66. The recess 67 assists smooth rotation of the locking ring 58.

Figure 3:
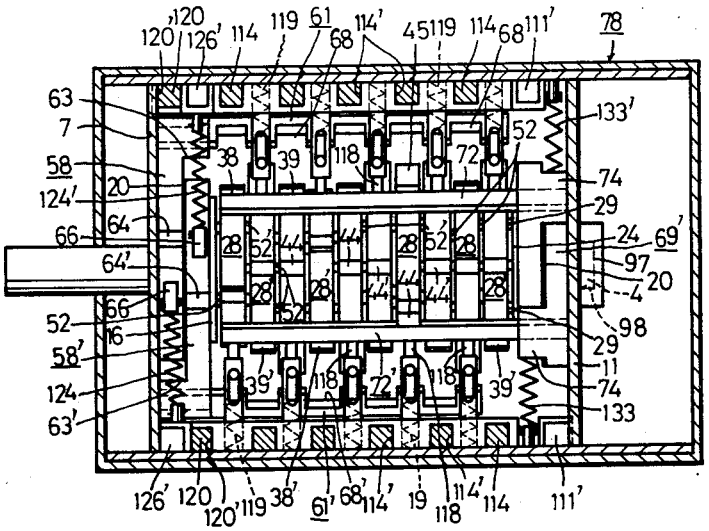
FIG. 3 is a view of a vertical section through the lock casing and showing many parts therein in front elevation.
Figure 4:
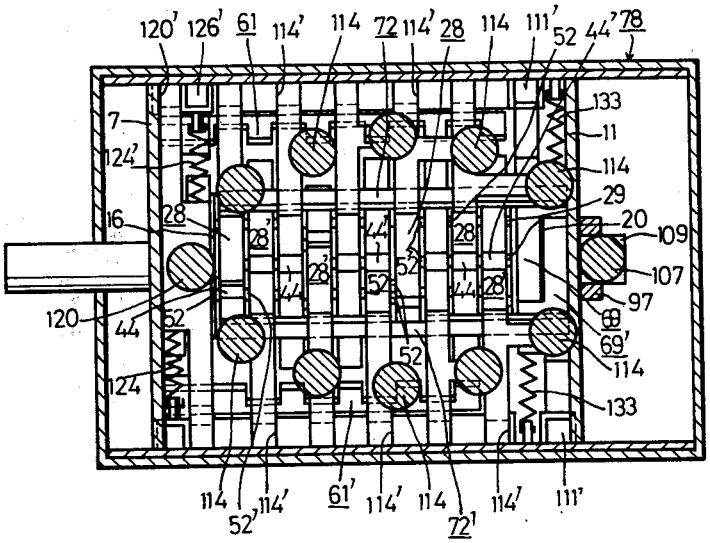
FIG. 4 is a view similar to FIG. 3, but showing a different vertical section.
Figure 5:
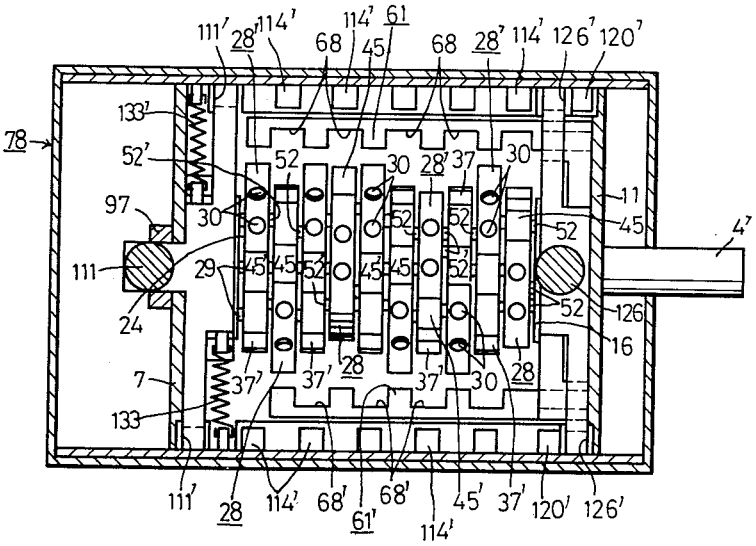
FIG. 5 is a view of a vertical section through the lock casing and showing many parts therein in rear elevation.

The driving rod 61 is formed with five notches 68 as shown in FIG. 49. In the door lock assembly of this invention, the five tumbler rings 28 and the five tumbler rings 28′ are placed in alternating relationship to each other as shown, for example, in FIG. 3. As shown in FIG. 3, each of the tumbler rings 28 is aligned with one of the notches 68, while each of the tumbler rings 28′ is aligned with one of the unnotched portions or teeth on the driving rod 61. Each unnotched portion of the driving rod 61 engages the finger 45′ on one of the tumbler rings 28′ to thereby rotate the tumbler ring 28′. The notches 68 are provided for preventing interference of the driving rod 61 with the operation of the fingers 45 on the tumbler rings 28.

Figure 50:
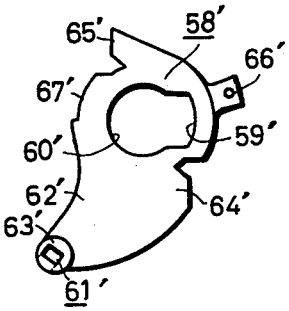
FIG. 50 is a side elevational view of the other locking ring.
Figure 51:
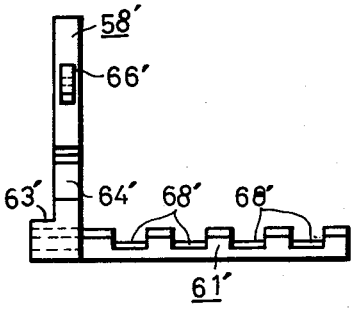
FIG. 51 is a front elevational view of the locking ring of FIG. 50 shown with another driving rod.

The door lock of this invention further includes a second driving ring for the locking purpose which is shaped in the inverted form of the first mentioned locking ring 58. The second locking ring 58' is shown in FIG. 50. Compare FIGS. 48 and 50, and look particularly at the counterparts of the driving lever 62, the ratchets 64 and 65 and the lug 66 which are shown at 62', 64', 65' and 66', respectively, in FIG. 50. Also, compare the position of the increased thickness portion 63 and its counterpart shown at 63' in FIGS. 50 and 51. The second locking ring 58' is otherwise similar to the first locking ring 58. The locking ring 58' has a central hole 60' and a laterally recessed opening 59' which is alignable with the guide opening 8 of the end plate 7. The driving lever 62' radially outwardly extends from the peripheral edge of the central hole 60' in a symmetrically opposite relation to the driving lever 62 of the first locking ring 58 as is obvious from the comparison of FIGS. 48 and 50. A driving rod 61' is connected at one end to the increased thickness portion 63' at the free end of the driving lever 62' and extends in a direction opposite to the increased thickness portion 63' as best shown in FIG. 51. The driving rod 61' is so positioned relative to the finger 45 on the tumbler ring 28 in their assembled position as has hereinbefore been described with respect to the driving rod 61 and the finger 45' on the tumbler ring 28'. The first ratchet 64' is so positioned as to permit rotation of the locking ring 58' by an angular distance equal to three times as large as a predetermined angle upon clockwise application of force to the ratchet 64'. Likewise, the second ratchet 65' is positioned to permit rotation of the locking ring 58' by an angular distance equal to three times as large as a predetermined angle upon clockwise application of force to the ratchet 65'. A spring is fastened to the lug 66'. The locking ring 58' is circumferentially recessed at 67' for its smooth rotation as will hereinafter be noted in further detail. The driving rod 61' is formed with four longitudinally spaced notches 68' as shown in FIG. 51. As shown in FIG. 3, each notch 68' is aligned with one of four out of the five tumbler rings 28', while each unnotched portion or tooth of the driving rod 61' is aligned with one of the tumbler rings 28. The driving rod 61' thus engages the finger 45 on each tumbler ring 28 to cause rotation of the tumbler ring 28. Because of the provision of the notches 68', however, the driving rod 61' moves past the finger 45' on each tumbler ring 28' and does not interfere with the function of the finger 45'.

Figure 52:
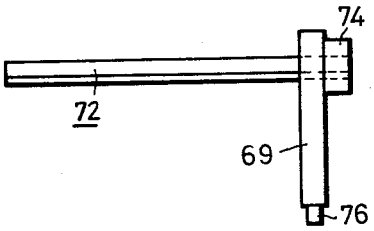
FIG. 52 is a front elevational view of one of a pair of unlocking rings shown with a driving rod.
Figure 53:
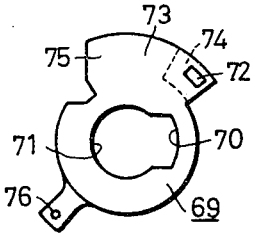
FIG. 53 is a side elevational view of the unlocking ring shown in FIG. 52.

FIG. 53 illustrates a first driving ring for the unlocking purpose which is generally indicated at 69. The unlocking ring 69 is centrally formed with a circular hole 71 for insertion of the lock shaft 1 and a laterally recessed opening 70 which is alignable with the guide opening 8 of the end plate 7. A driving lever 73 radially outwardly extends from the peripheral edge of the central hole 71 and has an increased thickness portion 74 to which a driving rod 72 is rigidly connected as shown in FIG. 52. The driving rod 72 is so positioned relative to the unlocking ring 69 that the driving rod 72 is spaced from the finger 44' on the tumbler ring 28' by an angular distance equal to twice as large as a predetermined angle when the unlocking ring 69 is placed alongside of the tumbler ring 28' with the former's recessed opening 70 and central hole 71 aligned with the latter's recessed opening 32' and central hole 33', respectively. As shown in FIG. 52, the driving rod 72 extends in a direction opposite to that in which the increased thickness portion 74 projects from the unlcoking ring 69. A ratchet 75 is formed on the opposite edge of the driving lever 73 from the increased thickness portion 74 and is so positioned relative to the unlocking ring 69 that application of force to the ratchet 75 in a clockwise direction as viewed in FIG. 53 permits rotation of the unlocking ring 69 by an angular distance equal to twice as large as a predetermined angle. The unlocking ring 69 is further provided with a radially outwardly projecting lug 76 which is diametrically opposite to the increased thickness portion 74 and to which a spring is fastened.

The driving rod 72 is adapted to engage the finger 44 on the tumbler ring 28 or the finger 44' on the tumbler ring 28' to thereby rotate the tumbler ring 28 or 28' as will hereinafter be noted in further detail.

Figure 54:
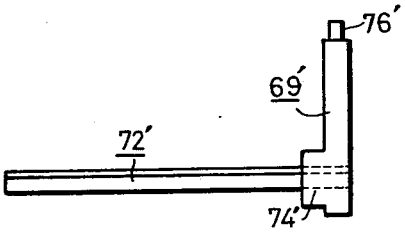
FIG. 54 is a front elevational view of the other unlocking ring shown with another driving rod.
Figure 55:
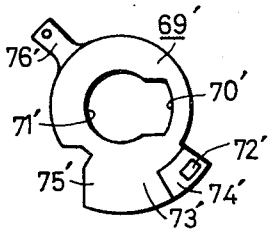
FIG. 55 is a side elevational view of the unlocking ring shown in FIG. 54.

A second unlocking ring 69' is shaped in the symmetrically inverted form of the first unlocking ring 69. Compare FIGS. 53 and 55 and particularly note the positions of a driving lever 73', a ratchet 75', a lug 76' and an increased thickness portion 74' in FIG. 55. The unlocking ring 69' likewise includes a central circular hole 71' and a laterally recessed opening 70'. A driving rod 72' is rigidly connected at one end to the increased thickness portion 74' which extends in the same direction as the driving rod 72' does, as shown in FIG. 54. The driving rod 72' is so positioned relative to the unlocking ring 69' that the driving rod 72' is spaced from the finger 44 on the tumbler ring 28 by an angular distance equal to twice as large as a predetermined angle when the unlocking ring 69' is placed alongside of the tumbler ring 28 with the former's recessed opening 70' and central hole 71' aligned with the latter's recessed opening 32 and central hole 33, respectively. The ratchet 75' is so positioned as to permit rotation of the unlocking ring 69' by an angular distance equal to twice as large as a predetermined angle upon application of force to the ratchet 75' in a counterclockwise direction as viewed in FIG. 55. The lug 76' has an aperture by which a spring is fastened to the lug 76'. The driving rod 72' is adapted to engage the finger 44 on the tumbler ring 28 or the finger 44' on the tumbler ring 28' to rotate the tumbler ring 28 or 28'.

Figure 42:
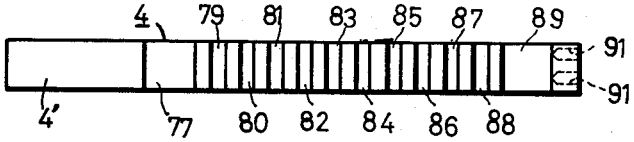
FIG. 42 is a front elevational view of the lock bolt.
Figure 43:
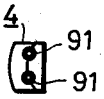
FIG. 43 is a side elevational view of the lock bolt.
Figure 44:
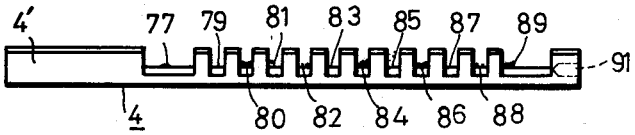
FIG. 44 is a bottom plan view of the lock bolt.

The lock bolt 4 includes an outward extension 4' which projects outwardly of a casing 78 as shown in, for example, FIG. 3. The extension 4' provides a means for manual handling of the lock bolt 4 for the locking purpose. The end plate 7 is spaced inwardly from an adjustment casing wall through which the lock bolt extension 4' projects. The lock bolt 4 is formed with a notch 77 (FIGS. 42 and 44) positioned immediately inwardly of the end plate 7 and having a longitudinal width which is equal to the combined thickness of the first locking ring 58, the washer 20 and the second locking ring 58'. Adjacent to the inner end of the lock bolt 4 remote from the outward extension 4', there is provided a similar notch 89 having a longitudinal width which is equal to the combined thickness of the first unlocking ring 69, the washer 20 and the second unlocking ring 69'. The notch 89 is spaced from the end of the lock bolt 4 by a distance which is equal to the thickness of the end plate 11 plus a lock bolt end portion on which a propelling member 90 is supported as will hereinafter be described in further detail. The lock bolt 4 is further formed with ten smaller notches 79 through 88 which are equally spaced from one another longitudinally of the lock bolt 4 to alternately receive releasably the upper tongue 35 or the lower tongue 36 on one tumbler ring 28 or the lower tongue 35' or the upper tongue 36' on an adjacent tumbler ring 28' as is obvious from FIG. 3. Each of the notches 79–88 has a width which is, as measured longitudinally of the lock bolt 4, substantially equal to the thickness of the tongue 35 on the tumbler ring 28. The first smaller notch 79 closest to the first major notch 77 is spaced from the latter by a distance equal to the thickness of the washer 16 plus the length of the spacer projections 52 on the tumbler ring 28 and the depth of one of the reduced thickness portions 34 on the tumbler ring 28. The second smaller notch 80 is spaced from the first notch 79 by a distance equal to the depth of the other reduced thickness portion 34 on the tumbler ring 28 plus the length of the spacer projections 52' on an adjacent tumbler ring 28' and the depth of one of the reduced thickness portions 34' on the tumbler ring 28'. The remaining notches 81–88 are spaced from one another by the same distance that keeps the first and second notches 79 and 80 apart from each other. The second major notch 89 is spaced from the tenth smaller notch 88 by a distance equal to the depth of one of the reduced thickness portions 34' on an adjacent tumbler ring 28' plus the thickness of the washer 24. The inner end of the lock bolt 4 is formed with a pair of tapped holes 91 extending longitudinally of the lock bolt 4 and each adapted to receive a screw by which the propelling member 90 is secured to the lock bolt 4.

Figure 6:
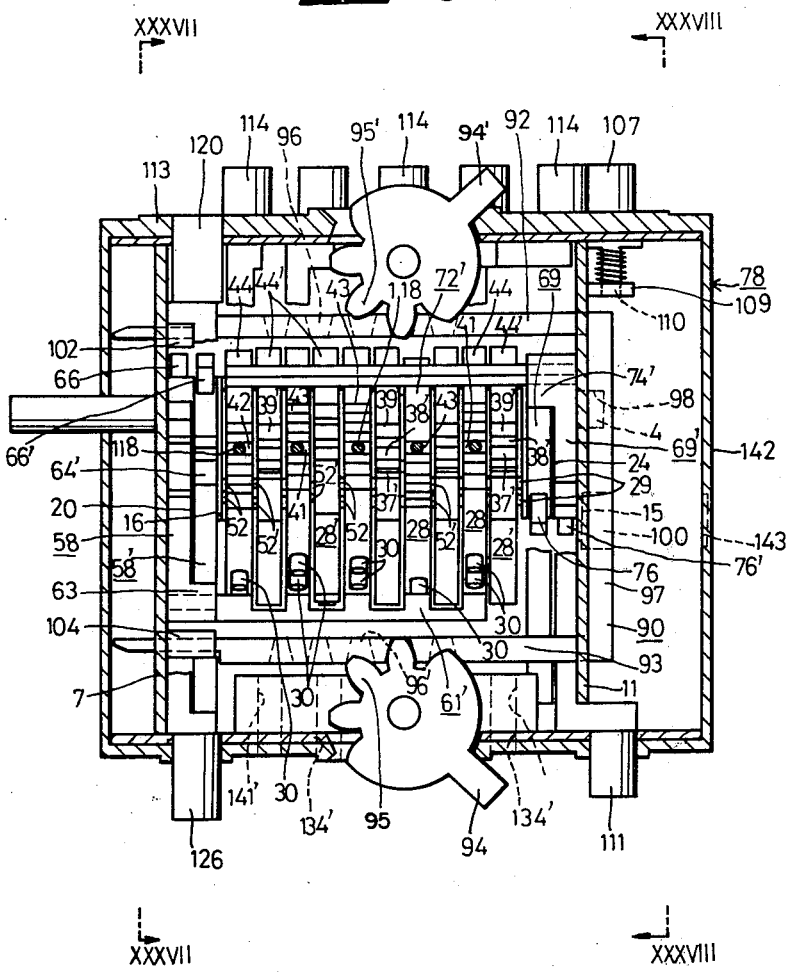
FIG. 6 is a view of a horizontal section through the lock casing and showing many parts in bottom plan.

The propelling member 90 has a generally U-shaped configuration in plan and comprises a pair of parallel leg portions 92 and 93 which are parallel to the lock bolt 4 and extend along and somewhat inwardly of the front and rear ends 113 and 125, respectively, of the casing 78 as shown in FIG. 6. The leg portions 92 and 93 are connected by an end portion 97 which extends along the end plate 11 somewhat inwardly of one lateral end 142 of the casing 78. The propelling member 90 is adapted for driving the lock bolt 4 forward and backward. The front leg portion 92 is formed therethrough in its midportion with a plurality of tooth receiving apertures 96 spaced along the leg portion 92. The rear leg portion 93 is likewise provided with a plurality of tooth receiving apertures 96' as shown in FIG. 6. The end portion 97 is formed on its inner side with a hole 98 located closer to the front leg portion 92 than to the rear leg portion 93 and adapted for receiving the lock bolt 4 as shown by broken lines in FIG. 6. The end portion 97 is further formed therethrough with a pair of apertures 99 opening into the hole 98 and alignable with the tapped holes 91 (FIG. 42) on the lock bolt 4 to connect the lock bolt 4 to the end portion 97 by a pair of screws. A magnet 100 is mounted on the end portion 97 in a position closer to the rear leg portion 93 than to the front leg portion 92. The magnet 100 is disposed opposite to the iron piece 15 on the end plate 11 as illustrated in FIG. 6.

The door lock of this invention further includes a lock bolt driving levers 94 and 94' rotatably mounted on the front and rear end walls 113 and 125, respectively, of the casing 78 as shown in FIG. 6. The levers 94 and 94' cooperate with the propelling member 90 in driving the lock bolt 4 forward and backward. The front and rear levers 94 and 94' are disposed opposite to each other longitudinally of the casing 78 as illustrated in FIG. 6. The front and rear levers 94 and 94' each comprises a generally disc-shaped engage portion rotatably mounted on the casing 78 and a handle extension projecting out of the casing 78. The front lever 94 is formed with a plurality of teeth 95 spaced along the inner half of the circumference of its disc-shaped portion. The teeth 95 are engageable with the tooth receiving apertures 96 on the front leg portion 92 of the propelling member 90. The rear lever 94' is likewise formed with a plurality of teeth 95' engageable with the tooth receiving apertures 96' on the rear leg portion 93 of the propelling member 90. If the lever 94 is rotated clockwise or to the right as viewed in FIG. 6, the propelling member 90 is moved forward to the left as viewed in FIG. 6 to move the lock bolt 4 forward in the same direction until the magnet 100 on the end portion 97 contacts the iron piece 15 on the end plate 11 as illustrated in FIG. 6. To the contrary, if the lever 94 is turned counterclockwise or to the left as viewed in FIG. 6, the propelling member 90 is moved backward to the right as viewed in FIG. 6 by overcoming the magnetic attraction of the magnet 100 and the lock bolt 4 is thereby retracted.

The end plate 7 is formed therethrough with a pair of parallel slots 101 and 103 which extend parallel to, and are equally spaced from the opposite vertical edges of the end plate 7, and which perpendicularly cross a horizontal centerline of the end plate 7 on which the aperture 10 has its center, as shown in FIG. 37. The front and rear leg portions 92 and 93 of the propelling member 90 slidably extend through the slots 101 and 103, respectively, as shown in FIGS. 6 and 37. A pair of parallel guide members 102 and 104 each having a guide groove extending longitudinally of the propelling member 90 extend from the interior surface and the end plate 7 as shown in FIGS. 6 and 37. The front leg portion 92 is slidably received in the guide groove of the guide member 102 and the rear leg portion 93 is slidably received in the guide groove of the guide member 104.

The opposite end plate 11 is likewise provided with a pair of parallel slots 105 and 106 which are aligned with the slots 101 and 103 on the end plate 7 and through which the front and rear leg portions 92 and 93, respectively, of the propelling member 90 slidably extend (FIGS. 6 and 38). At its vertical edge remote from the rear end wall 125 of the casing 78, the end plate 11 is formed with a rectangular opening 108 lying on the horizontal centerline of the end plate as shown in FIG. 38. The opening 108 provides a clearance which allows for the axial movement of a switch button 107 mounted on the front end wall 113 of the casing 78. At the bottom of the opening 108, there is provided a stop member 109 adapted for limiting the inward movement of the switch button 107. The switch button 107 includes a coaxial inward extension and the stop member 109 has an aperture 110 in which the inward extension of the switch button 107 is slidably received. A similar opening 112 is recessed from the opposite vertical edge of the end plate 11 to mount axially movably a pushbutton 111 adapted to actuate the two unlocking rings 69 and 69' simultaneously.

Attention is now directed to a method of assembling the door lock of this invention.

A spring 46 is inserted into the bottom of each of the lateral bores 47 and 48 of each of the five tumbler rings 28. Likewise, a spring 46 is placed into the bottom of each of the lateral holes 47' and 48' of each of the other five tumbler rings 28'. An engage pin 30 is then placed into each of the lateral bores 47, 48, 47' and 48' with its inner end contacting the spring 46. Each engage pin 30 is inserted into the lateral bore to the extent that its third recess 57 is aligned with the aperture 50 or 51 of the tumbler ring 28 or the aperture 50' or 51' of the tumbler ring 28'. A stop pin 49 is inserted into the third recess 57 through the aperture 50, 51, 50' or 51' to hold the engage pin 30 in such a position relative to the tumbler ring 28 or 28' that is is concealed in the associated lateral bore along the greater part of its length, while a minor lengthwise portion of each engage pin 30 is exposed beyond the outer extremity of the lateral extension 31 or 31' of each tumbler ring, as illustrated in FIG. 68.

The washer 24 is inserted over one end of the lock shaft 1 (i.e., the end disposed on the right-hand side of FIG. 6) in such a manner that its spacer projections 29 are directed inwardly, i.e., toward the center of the casing 78. Then, the first unlocking ring 69, the washer 20 and the second unlocking ring 69' are inserted over the end of the lock shaft 1 in that order. This insertion is done in such a manner that the recessed openings 25 and 21 of the washers 24 and 20, respectively, and the recessed openings 70 and 70' of the unlocking rings 69 and 69', respectively, are all aligned with the guide opening 12 of the end plate 11, and also that the driving rods 72 and 72' extend along the lock shaft 1 toward the other end of the latter. The lock shaft 1 is then secured to the end plate 11 by engagement of the projection 2' into the aperture 13 of the end plate 11 and insertion of a screw or the like into the tapped hole 3' through the aperture 14 as illustrated in FIG. 38. Then, the five tumbler rings 28' and the five other tumbler rings 28 are inserted over the other end of the lock shaft 1 in such a manner that their spacer projections 52' and 52 are directed toward the other end of the lock shaft 1, namely, in the same direction as the spacer projections 29 on the washer 24 face, and that their recessed openings 32' and 32 are all aligned with the guide opening 12 of the end plate 11.

The washer 16, the second locking ring 58', the washer 20 and the first locking ring 58 are then inserted over the lock shaft 1 as illustrated in FIG. 6. This insertion is done in such a fashion that the recessed openings 17 and 21 of the washers 16 and 20, respectively, and the recessed openings 59' and 59 of the locking rings 58' and 58, respectively, are all aligned with the guide opening 12 of the end plate 11, and also that the driving rods 61' and 61 extend along the lock shaft 1 toward the unlocking rings 69 and 69' carried on the remote end of the lock shaft 1. The lock shaft 1 is connected to the end plate 7 on that side of the latter from which the guide members 102 and 104 project as shown in FIG. 6. This connection is done by engagement of the projection 2 into the aperture 9 of the end plate 7 and insertion of a screw or the like into the tapped hole 3 of the lock shaft 1 through the aperture 10 of the end plate 7, as illustrated in FIG. 37.

The lock bolt 4 is inserted into the hole 98 on the end portion 97 of the propelling member 90 at its inner end as shown on the right-hand side of FIG. 6. The apertures 99 on the propelling member 90 are aligned with the tapped holes 91 on the lock bolt 4 as can be seen from FIG. 38 and a screw or the like is inserted into each tapped hole 91 through the corresponding aperture 99 to secure the lock bolt 4 to the propelling member 90. The lock bolt 4 extends through the guide opening 12 of the end plate 11, along the guide groove 5 of the lock shaft 1 and through the guide opening 8 of the end plate 7. The front leg portion 92 of the propelling member 90 extends through the slot 105 of the end plate 11, the guide member 102 and the slot 101 of the end plate 7. Likewise, the rear leg portion 93 extends through the slot 106 of the end plate 11, the guide member 104 and the slot 103 of the end plate 7. The lock bolt 4 projects from the casing 78 to the extent that the magnet 100 on the propelling member 90 contacts the iron piece 15 on the end plate 11 as illustrated in FIG. 6.

Figure 1:
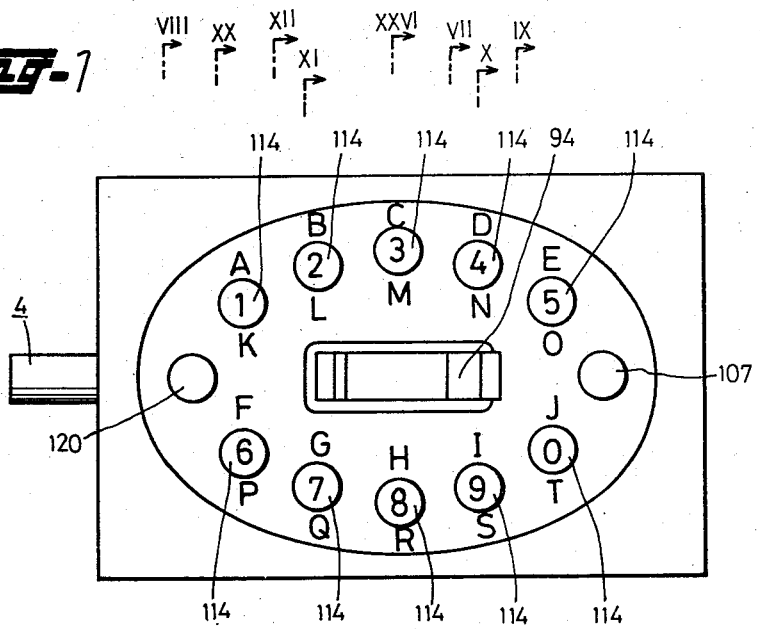
FIG. 1 is a front elevational view of the door lock embodying this invention.

The front lever 94 is mounted on the front end wall 113 of the casing 78 approximately in the center thereof, as shown in FIGS. 1 and 6, with its teeth 95 engaged in the tooth receiving apertures 96 of the front leg portion 92 of the propelling member 90 and its handle extension projecting from the casing 78.

Figure 12:
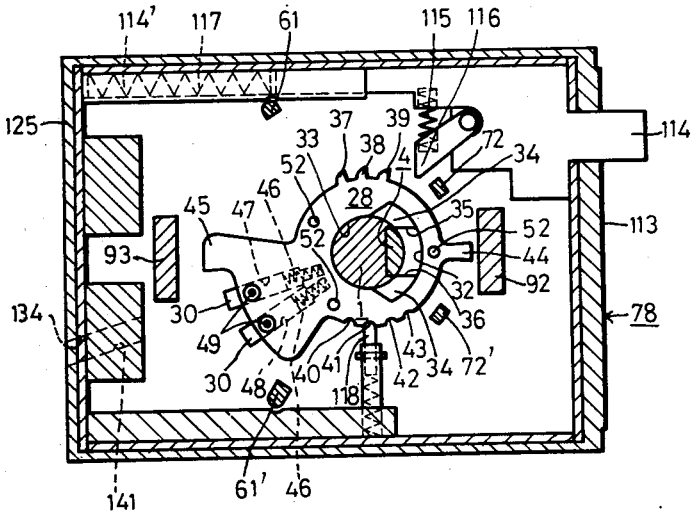
FIG. 12 is a vertical sectional view taken along the line XII—XII of FIG. 1.

The door lock of this invention further includes ten pushbuttons 114 each adapted to actuate one of the 10 tumbler rings 28 and 28'. As shown in FIGS. 10 and 12, each pushbutton 114 comprises a head portion projecting outwardly from the front end wall 113 of the casing 78 and a body portion connected to the head portion and slidably supported within the casing 78. A pawl member 116 is rotatably carried on the body portion and loaded by a spring 115. The pawl member 116 on each pushbutton 114 is engageable with the ratchet 37, 38 or 39 or 37', 38' or 39' of one of the tumbler rings 28 and 28' when the pushbutton 114 is depressed. A return spring 117 is associated with each pushbutton 114 to permit rotation of one of the tumbler rings 28 and 28' by a predetermined angle each time the pushbutton 114 is depressed. Due to the symmetrically opposite construction of the five tumbler rings numbered 28 relative to the other five tumbler rings 28' as already described, all the pushbuttons 114 are of the identical construction, but have their head portions projecting from the front end wall 113 of the casing 78 in a generally elliptical pattern as shown in FIG. 1. For the sake of convenience, the 10 pushbuttons 114 are digitally identifiable as shown in FIG. 1. The user of this door lock may select some of these numerals to formulate a desired number which he may wish to remember and use as a code for operation of the door lock. Further, or alternatively, the exterior surface of the front end wall 113 of the casing 78 may advantageously carry a series of alphabetical letters adjacent to the respective pushbuttons 114 as shown in FIG. 1. The user may choose a number of alphabetical letters to formulate a word which he may consider easy to remember for use as a code for door lock operation.

Figure 7:
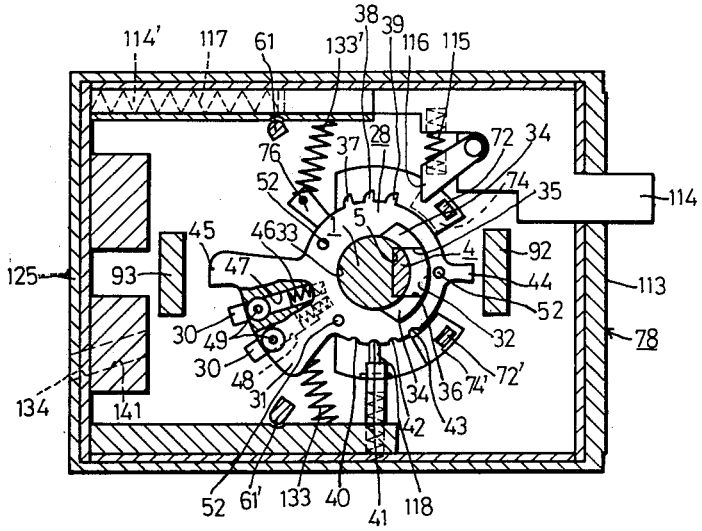
FIG. 7 is a vertical sectional view taken along the line VII—VII of FIG. 1.

The door lock of this invention further includes ten positioning pins 118 each engaged with one of the tumbler rings 28 and 28' as shown in FIG. 3 to hold each tumbler ring in position. Each positioning pin 118 is supported on a spring 119 in the casing 78 and has a free end extending beyond the spring 119 and engaged in one of the peripheral recesses 40 through 43 or 40' through 43' of one of the tumbler rings 28 and 28' to hold the tumbler ring in position as shown, for example, in FIG. 7.

Figure 8:
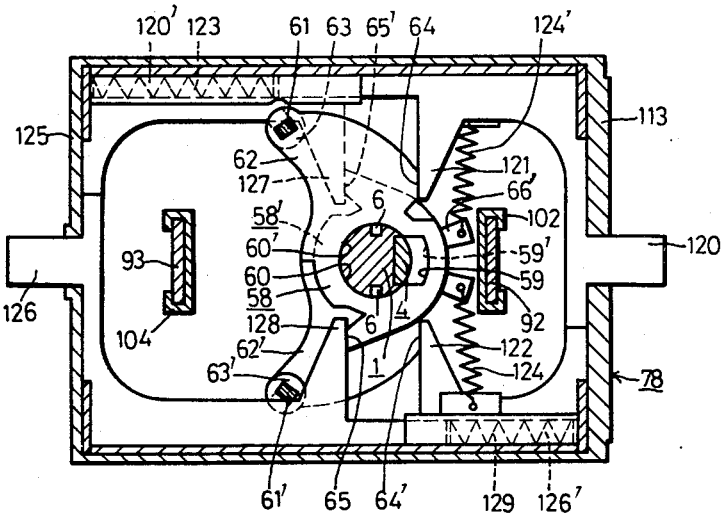
FIG. 8 is a vertical sectional view taken along the line VIII—VIII of FIG. 1.

Numeral 120 indicates a pushbutton adapted to drive the two locking rings 58 and 58' simultaneously. The pushbutton 120 includes a head portion extending outwardly from the front end wall 113 of the casing 78 as shown in FIG. 8. The pushbutton 120 further includes an inwardly extending body portion which is substantially of the inverted C-shaped construction as viewed in FIG. 8. The body of the pushbutton 120 is formed by an upwardly and a downwardly extending portion in the casing 78. A finger 121 projects from the upwardly extending portion and engages the ratchet 64 on the first locking ring 58. A similar finger 122 projects from the downwardly extending portion of the pushbutton 120 and engages the ratchet 64' on the second locking ring 58'. Each of the upwardly and downwardly extending portions of the pushbutton 120 has a free end portion slidably extending along the interior surface of the casing 78 and supported on a return spring 123. A spring 124 is fastened at one end to the lug 66 on the first locking ring 58 and has another end fastened to a member on the interior surface of the casing 78. A like spring 124' is connected between the lug 66' on the second locking ring 58' and a member on the opposite interior surface of the casing 78 as shown in FIG. 8. The springs 124 and 124' serve to maintain the ratchets 64 and 64' in contact with the fingers 121 and 122 respectively. Each time the pushbutton 120 is depressed, the finger 121 is inwardly displaced to rotate the first locking ring 58, with the driving rod 61 carried thereon, by an angular distance equal to three times as large as a predetermined angle against the action of the spring 124. Simultaneously, the finger 122 is inwardly displaced to rotate the second locking ring 58', with the driving rod 61' carried thereon, by the same angular distance against the action of the spring 124'. Consequently, upon rotation of any one of the tumbler rings 28, the driving rod 61' engages either the finger 45 on the tumbler ring 28 or the engage pin 30 projecting from the lateral bore 47 or 48 of the tumbler ring 28. Likewise, upon rotation of any one of the tumbler rings 28', the driving rod 61 engages either the finger 45' on the tumbler ring 28' or the engage pin 30 projecting from the lateral bore 47' or 48' of the tumbler ring 28'. Thus, the tumbler rings 28 and 28' are rotated simultaneously into their normal locked position.

The rear lever 94' is mounted on the rear end wall 125 of the casing 78 approximately in the center thereof with its teeth 95' engaged in the tooth receiving apertures 96' of the rear leg portion 93 of the propelling member 90 and its handle extension projecting from the casing 78.

Numeral 126 indicates another pushbutton adapted to drive the two locking rings 58 and 58' simultaneously. The pushbutton 126 includes a head portion extending outwardly from the rear end wall 125 of the casing 78 as shown in FIG. 8. The pushbutton 126 is generally similar in construction to the pushbutton 120 on the front side of the casing 78. The pushbutton includes an inwardly extending body portion which has a substantially C-shaped configuration as viewed in FIG. 8. The body of the pushbutton 126 is formed by an upwardly and a downwardly extending portion disposed opposite to the pushbutton 120 in the casing 78. A finger 127 projects from the upwardly extending portion and engages the ratchet 65' on the second locking ring 58'. A similar finger 128 projects from the downwardly extending portion and engages the ratchet 65 on the first locking ring 58. Each of the upwardly and downwardly extending portions of the pushbutton 126 has a free end portion slidably extending along the interior surface of the casing 78 and supported on a return spring 129. The ratchet 65' is normally maintained in contact with the finger 127 by the spring 124', while the ratchet 65 is normally maintained in contact with the finger 128 by the spring 124. Each time the pushbutton 126 is depressed, the finger 127 is inwardly displaced to rotate the second locking ring 58', with the driving rod 61' carried thereon, by an angular distance equal to three times as large as a predetermined angle against the action of the spring 124'. Simultaneously, the finger 128 is inwardly displaced to rotate the first locking ring 58, with the driving rod 61 carried thereon, by the same angular distance against the action of the spring 124. Consequently, upon rotation of any one of the tumbler rings 28, the driving rod 61' engages either the finger 45 on the tumbler ring 28 or the engage pin 30 projecting from the lateral bore 47 or 48 of the tumbler ring 28. Likewise, upon rotation of any one of the tumbler rings 28', the driving rod 61 engages either the finger 45' on the tumbler ring 28' or the engage pin 30 projecting from the lateral bore 47' or 48' of the tumbler ring 28'. Thus, the tumbler rings 28 and 28' are rotated simultaneously into their normal locked position.

Figure 9:
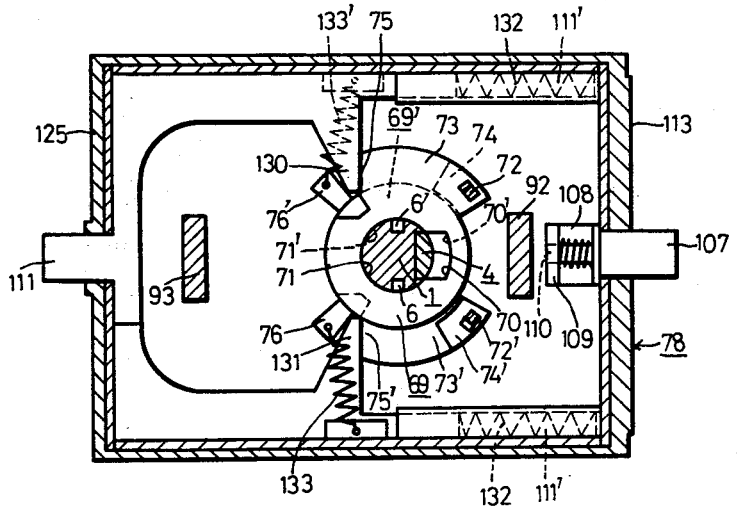
FIG. 9 is a vertical sectional view taken along the line IX—IX of FIG. 1.

The door lock of this invention further includes a pushbutton 111 adapted to drive the two unlocking rings 69 and 69' simultaneously. As shown in FIG. 9, the pushbutton 111 includes a head portion projecting outwardly from the rear end wall 125 of the casing 78, and an inwardly extending body portion formed by an upwardly and a downwardly extending portion in the casing 78. A finger 130 projects from the upwardly extending portion and engages the ratchet 75 on the first unlocking ring 69. A similar finger 131 projects from the downwardly extending portion and engages the ratchet 75 on the second unlocking ring 69'. Each of the upwardly and downwardly extending portions has a free end portion slidably extending along the interior surface of the casing 78 and supported on a return spring 132. A spring 133 is fastened at one end to the lug 76 on the first unlocking ring 69 and has another end fastened to a member in the casing 78. A similar spring 133' is connected between the lug 76' on the second unlocking ring 69' and the casing 78. The springs 133 and 133' normally maintain the ratchets 75 and 75' in contact with the fingers 130 and 131, respectively. Each time the pushbutton 111 is depressed, the finger 130 is inwardly displaced to rotate the first unlocking ring 69, with the driving rod 72 carried thereon, by an angular distance equal to twice as large as a predetermined angle against the action of the spring 133. Simultaneously, the finger 131 is inwardly displaced to rotate the second unlocking ring 69', with the driving rod 72' carried thereon, by the same angular distance against the action of the spring 133'. Consequently, upon rotation of any one of the tumbler rings 28 and 28', the driving rods 72 and 72' engage the fingers 44 and 44' on the tumbler rings 28 and 28', respectively, so that the tumbler rings 28 and 28' are rotated simultaneously into the position in which their recessed openings 32 and 32' are aligned with the guide opening 12 of the end plate 11.

Figure 2:
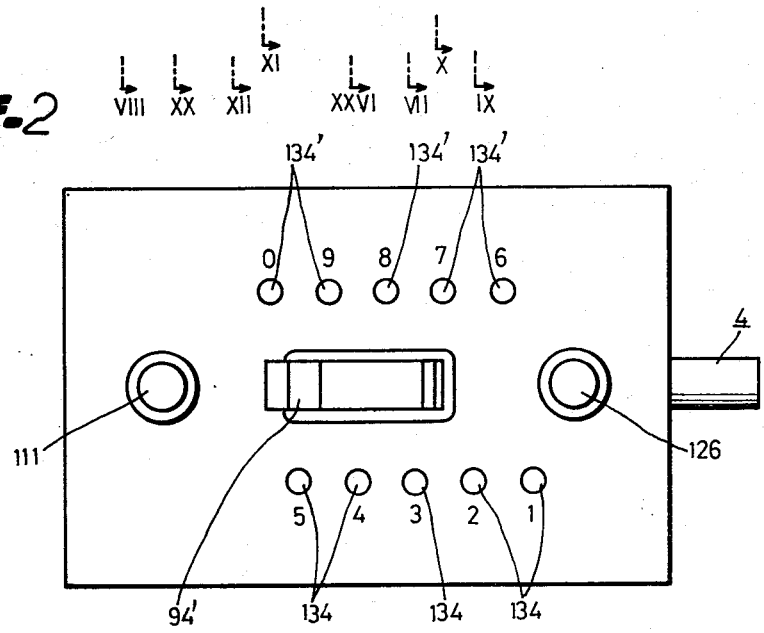
FIG. 2 is a rear elevational view of the door lock.

The rear end wall 125 is provided therethrough with a series of five guide apertures 134 as shown in FIG. 2. Each aperture 134 has a longitudinal axis extending at an angle to the rear end wall 125 and lying on an extension of the lateral bore 47 of one tumbler ring 28 as shown in FIG. 12 when the tumbler ring 28 stays in its position in which its recessed opening 32 is aligned with the guide opening 12 of the end plate 11. The five apertures 134 each operationally related to one tumbler ring 28 are positioned on the lower half of the rear end wall 125 of the casing 78, while the five pushbuttons 114 each adapted to operate one tumbler ring 28 are located on the upper half of the front end wall 113. The rear end wall 125 is also provided therethrough on the upper half thereof with another series of five guide apertures 134' as shown in FIG. 2, while the remaining five pushbuttons 114 each adapted to operate one of the tumbler rings 28' are located on the lower half of the front end wall 113. Each aperture 134' has a longitudinal axis extending at an angle to the rear end wall 125 and lying on an extension of the lateral bore 47' of one tumbler ring 28' as shown in FIG. 10 when the tumbler ring 28' stays in its position in which its recessed opening 32' is aligned with the guide opening 12 of the end plate 11. The five apertures 134' are each operationally related to one of the tumbler rings 28' as will hereinafter be described in further detail. The exterior surface of the rear end wall 125 may conveniently carry adjacent to the apertures 134 and 134' the same numerals as are carried by the corresponding pushbuttons 114 on the front end wall 113, as shown in FIGS. 1 and 2. Further, the rear end wall 25 may advantageously carry the corresponding alphabetical letters as has been described and shown with respect to the front end wall 113.

The casing 78 has a pair of vertically spaced, horizontally elongate blocks attached to the interior surface of the rear end wall 125 as shown in, for example, FIG. 12. The lower block is provided therethrough with a series of five bores 141 extending at an angle to the rear end wall 125 and each connected with one of the apertures 134 coaxially therewith as shown in FIG. 12. Likewise, the upper block has five similar bores 141' each connected with one of the apertures 134' coaxially therewith as shown in FIG. 10.

Figure 14:
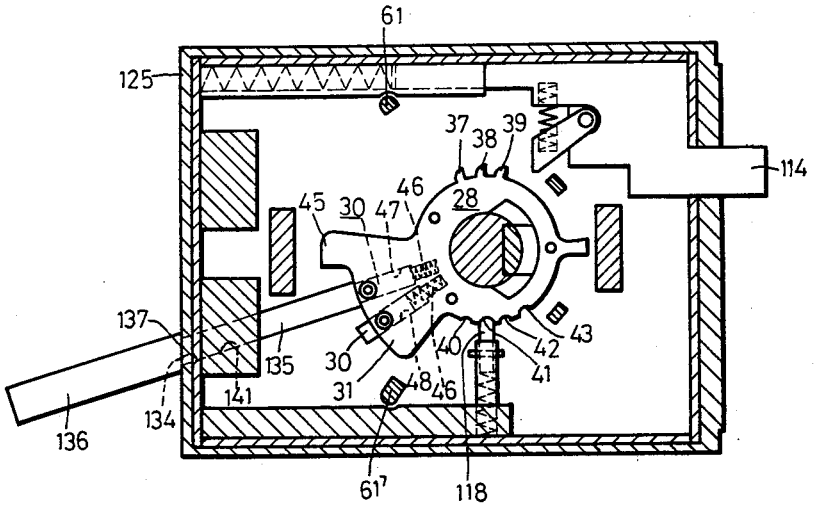

Referring to FIG. 14, numeral 135 indicates a first cylindrical guide rod having a handle extension 136 connected to one end thereof. Tha handle extension 136 is greater in diameter than the guide rod 135 and that end of the handle extension 136 at which it is connected to the guide rod 135 has an inclined face 137 adapted to closely fit the exterior surface of the rear end wall 125 when the guide rod 135 is totally inserted into the casing 78 as shown in FIG. 14. The guide rod 135 is adapted for insertion through one pair of the apertures 134 or 134' and the bores 141 or 141' to guide protrusion of one engage pin 30 out of the lateral bore 47 or 48 or 47' or 48' of the corresponding tumbler ring 28 or 28'. The guide rod 135 has a length which is sufficient to permit its free end to reach the outer edge of the tumbler ring extension 31 or 31' when the guide rod 135 is totally inserted in the casing 78 with the inclined face 137 of the handle extension 136 contacting the rear end wall 125 as shown in FIG. 14.

Figure 35:
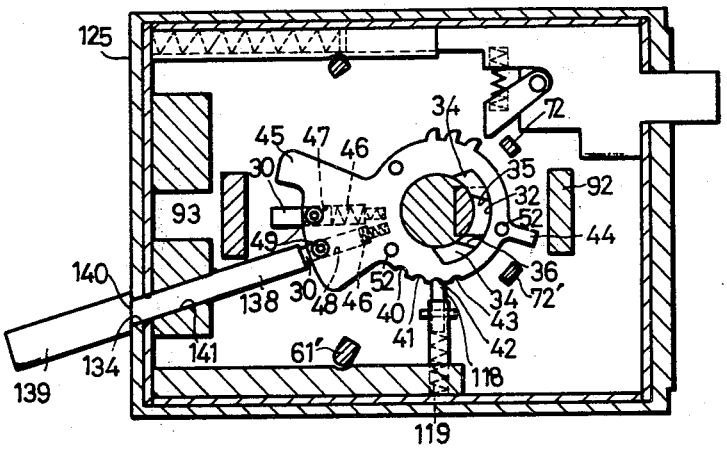
FIG. 35 is a view similar to FIG. 26, but illustrating the various parts in a different operational position.
Figure 36:
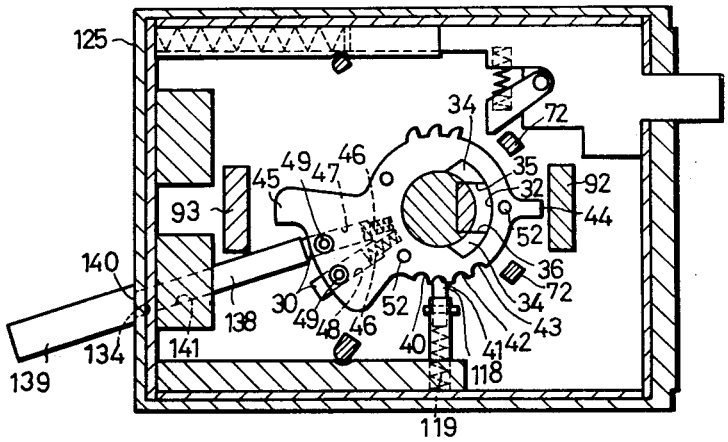
FIG. 36 is a view similar to FIG. 20, but illustrating the various parts in a different operational position.

A second cylindrical guide rod 138, which is similar to the first guide rod 135 in construction, has a handle extension 139 connected to one end thereof and having one end face 140 inclined to closely fit the exterior surface of the rear end wall 125 as shown in FIGS. 35 and 36. The guide rod 138 is adapted to extend through any one of the apertures 134 and 134' and the corresponding bore 141 or 141' and abut on one engage pin 30 to guide insertion of the engage pin 30 into one of the lateral bores of the corresponding tumbler ring 28 or 28'. The handle extension 139 is greater in diameter than the guide rod 138. As is obvious from comparison of FIGS. 14 and 35, the second guide rod 138 is somewhat smaller in length than the first guide rod 135 and fails to reach the outer edge of the tumbler ring extension even when it is totally inserted in the casing 78.

A piece of iron 143 is attached to the interior surface of one side wall 142 of the casing 78 and faces the magnet 100 on the end portion 97 of the propelling member 90.

Figure 30:
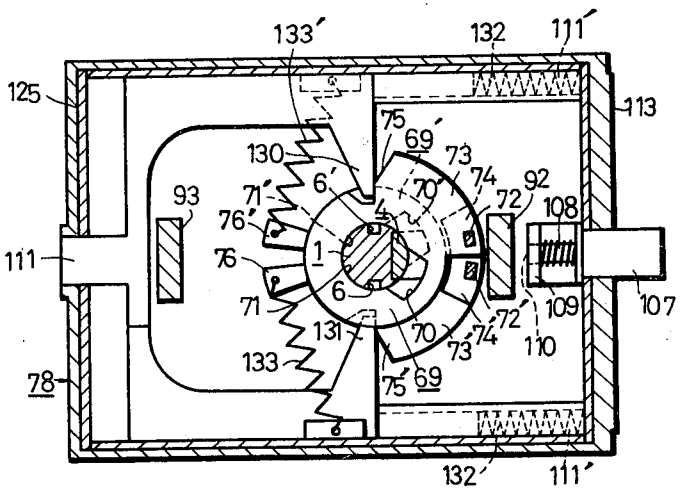
FIGS. 30 through 34 are views similar to FIG. 9, but illustrating the various parts in different operational positions.
Figure 31:
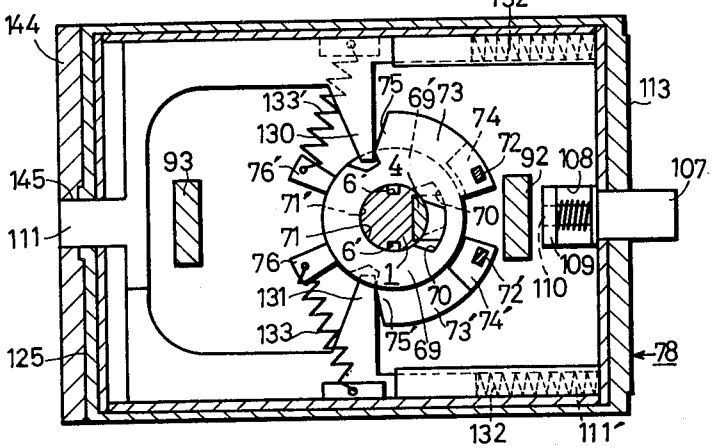

The door lock of this invention further includes a pushbutton adaptor 144 adapted for use with the pushbutton 111 to change the code number formulated by selecting a desired number of numerals or alphabetical letters assigned to the pusbuttons 114 for the unlocking purpose. The pushbutton adaptor 144 is shown in FIG. 31. The pushbutton adaptor 144 is provided in its center therethrough with an opening 145 through which the pushbutton 111 can extend. The adaptor 144 comprises a generally flat plate having a thickness which is equal to about a half of the length of that portion of the pushbutton 111 which projects outwardly from the rear end wall 125 when the pushbutton 11 is in its fully outwardly retracted position. It will, thus, be observed that when the adaptor 144 is inserted over the pushbutton 111 and the pushbutton 111 is depressed, the depth of its depression can be reduced to about a half as is obvious from comparison of FIGS. 30 and 31, whereby the angle of rotation of the unlocking rings 69 and 69' may be reduced to a half.

The switch button 107 may be used as a button for switching on and off a buzzer or bell, as desired.

Numerals 11', 114', 120' and 126' indicate support members on the interior surface of the casing 78 having bores in which the free end portions of the pushbuttons 111, 114, 120 and 126, respectively, are slidably received.

In the door lock of this invention as assembled as hereinabove described, all of the tumbler rings 28 and 28' stay in their positions shown in FIGS. 12 and 10, respectively, in which their recessed openings 32 and 32' are aligned with the guide opening 12 of the end plate 11. The lock bolt 4 extends along the guide groove 5 of the lock shaft 1 and stays in its disengaged position. The engage pin 30 for each of the lateral bores 47, 48, 47' and 48' of the tumbler rings is held in the corresponding lateral bore along the major part of its length as shown in FIGS. 12 and 10. Thus, all of the tumbler rings 28 and 28' are in their inoperative position.

Figure 11:
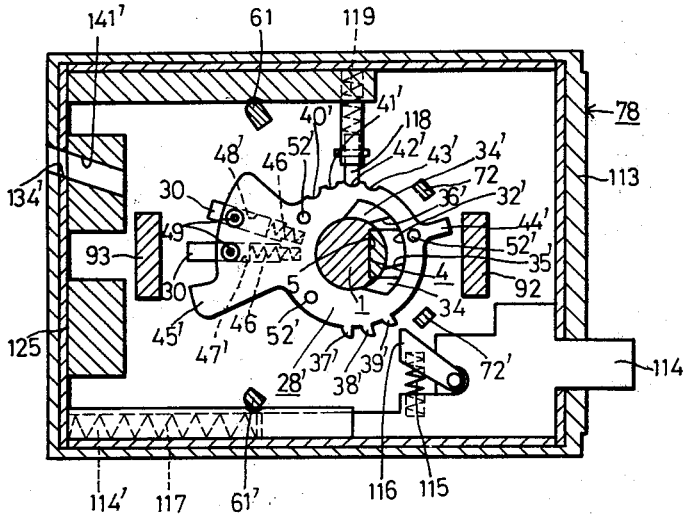
FIG. 11 is a vertical sectional view taken along the line XI—XI of FIG. 1.
Figure 20:
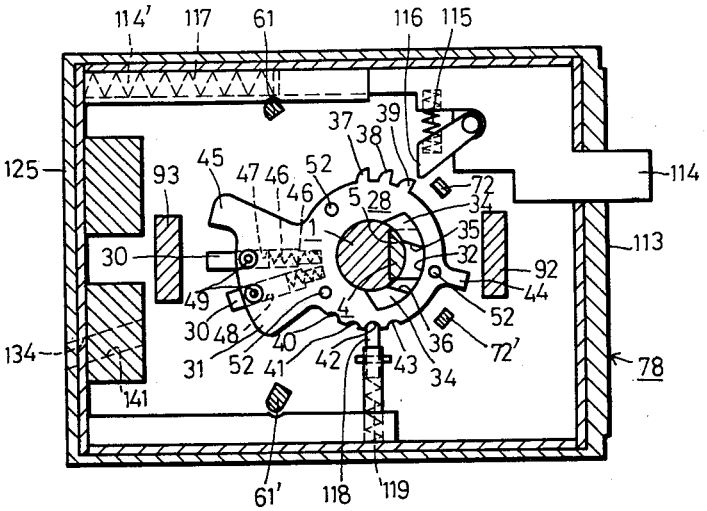
FIG. 20 is a vertical sectional view taken along the line XX—XX of FIG. 1.

In order to bring the door lock into its locked position, it is necessary to rotate one or more of the tumbler rings 28 and 28' into their position shown in FIGS. 20 and 11, respectively, in which the upper tongue 35 on the or each tumbler ring 28 or the lower tongue 35' on the or each tumbler ring 28' is engaged in one of the notches 79 through 88 on the lock bolt 4 to thereby hold the lock bolt 4 axially immovably.

The invention will now be described by way of several examples of use in which a code number is arbitrarily chosen for the locking and unlocking operation.

The number "1744" is selected as a code number to set the door lock so that it can be opened only when the pushbuttons 114 carrying the numerals "1" and "7" are depressed in that order successively, followed by the twice repeated depression of the pushbutton 114 to which the numeral "4" is assigned. In this position of the door lock, the remaining seven pushbuttons 114 stay in their inoperative position. They may be called makebelieve pushbuttons and do not in any way take part in the operation of the door lock. For the purpose of simplicity and clarfication, the three pushbuttons 114 to which the numerals "1", "7" and "4", respectively, are allocated may hereinafter be called the "1" pushbutton 114, "7" pushbutton 114 and "4" pushbutton 114, respectively; the tumbler rings 28 and 28' which are operationally associated with the "1", "7" "4" pushbuttons 114 will be called the "1" tumbler ring 28, "7" tumbler ring 28' and "4" tumbler ring 28; and the rear end wall apertures 134 and 134' operationally associated with the "1", "7" and "4" tumbler rings will be called the "1" aperture 134, "7" aperture 134' and "4" aperture 134. respectively.

Figure 15:
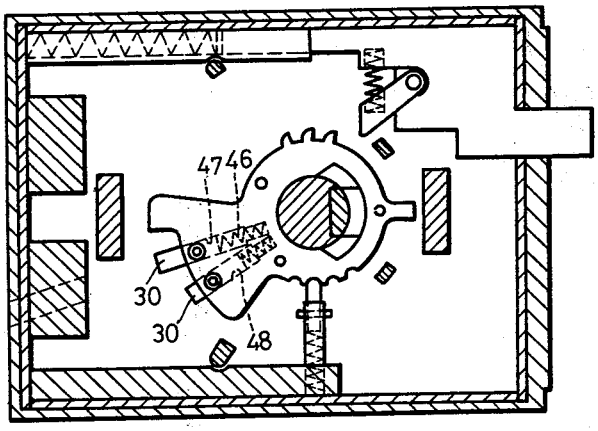

On the indoor side of a door on which the door lock of this invention may usually be mounted, the guide rod 135 is inserted through each of the "1" aperture 134, "4" aperture 134 and "7" aperture 134' until the inclined end face 137 of its handle extension 136 contacts the exterior surface of the rear end wall 125. The inner end of the guide rod 135 abuts on each corresponding engage pin 30 and effects further insertion of the engage pin 30 into the lateral bore 47 of the corresponding "1" or "4" tumbler ring 28. While the stop pin 49 is itself stationary and the engage pin 30 is movable, the stop pin 49 is herein described as moving relative to the engage pin 30 or any relevant portion thereof for the purpose of facilitating the explanation. The stop pin 49 leaves the third recess 57 on each engage pin 30 and moves along the first guide groove 55, as the engage pin 30 is pushed inwardly and totally enclosed in the lateral bore 47, when the stop pin 49 is received in the second recess 54 on the engage pin 30, all in the manner already described. Upon removal of the external force from the engage pin 30 by withdrawal of the guide rod 135, the engage pin 30 is retracted outwardly by the action of the spring 46, whereupon the stop pin 49 leaves the second recess 54, moves along the second guide groove 56 and enters the first recess 53 as shown in FIG. 66. The engage pin 30 is thus positioned as shown in FIG. 15 and functionally takes the place of the finger 45. Likewise, the positional adjustment of the engage pin 30 in the lateral bore 47' of the "7" tumbler ring 28' is effected in a similar manner and the engage pin 30 projects to the extent that it can functionally take the place of the finger 45'.

Figure 17:
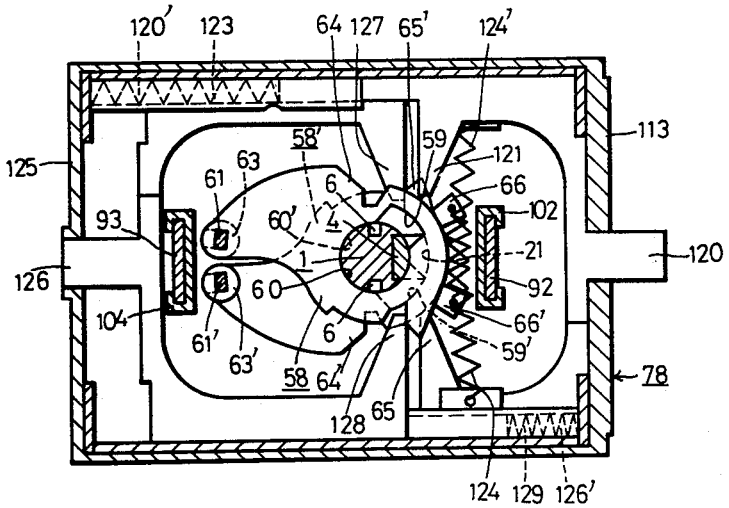
Figure 19:
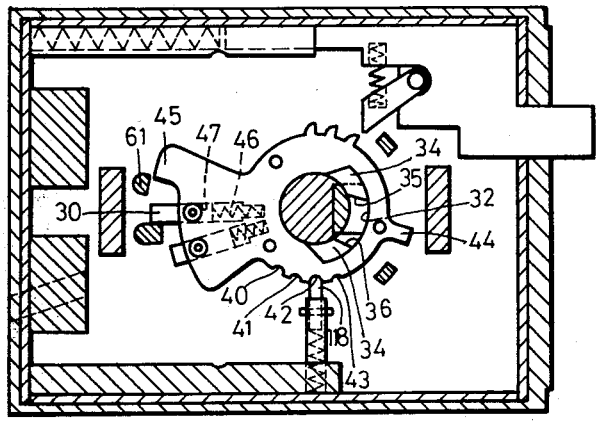

Then, the pushbutton 126 is depressed to move the first and second locking rings 58 and 58' simultaneously from the position shown in FIG. 8 to the position of FIG. 17. This is effected, as hereinbefore described, by the inward displacement of the fingers 128 and 127 on the pushbutton 126 which causes rotation of the first and second locking rings 58 and 58' about the lock skaft 1 by exerting force on the ratchets 65 and 65' against the action of the springs 124 and 124'. Consequently, the first and second driving rods 61 and 61' are moved into their respective positions shown in FIG. 17. Thus, as shown in FIGS. 15 and 19, the driving rod 61' engages the engage pins 30 projecting from the lateral bores 47 of the "1" and "4" tumbler rings 28, respectively, and the driving rod 61 engages the engage pin 30 projecting from the lateral bore 47' of the "7" tumbler rings 28', whereby the "1", "4" and "7" tumbler rings 28 and 28' are rotated by a predetermined angle. Then, the depression of the pushbutton 126 is discontinued and the pushbutton 126 returns to its original position under the action of the springs 129, while at the same time, the locking rings 58 and 58', along with the driving rods 61 and 61', return to their respective original positions under the action of the springs 124 and 124'. The "1" tumbler ring 28, "4" tumbler ring 28 and "7" tumbler ring 28', however, are maintained in their rotated position as shown in FIG. 20 by virtue of the positioning pins 118 engaging in the peripheral recesses 42 and 42' of the respective tumbler rings 28 and 28'. This is the position which is appropriate to the "1" and "7" tumbler rings 28 and 28', but is not yet suitable for the "4" tumbler ring 28 because the door lock is going to be set to be opened by twice repeated depression of the "4" pushbutton 114 following the depression of each of the "1" and "7" pushbuttons 114. It is, therefore, necessary to further adjust the position of the "4" tumbler ring 28 so that the door lock can be opened only when the "4" pushbutton 114 is twice depressed.

Figure 23:
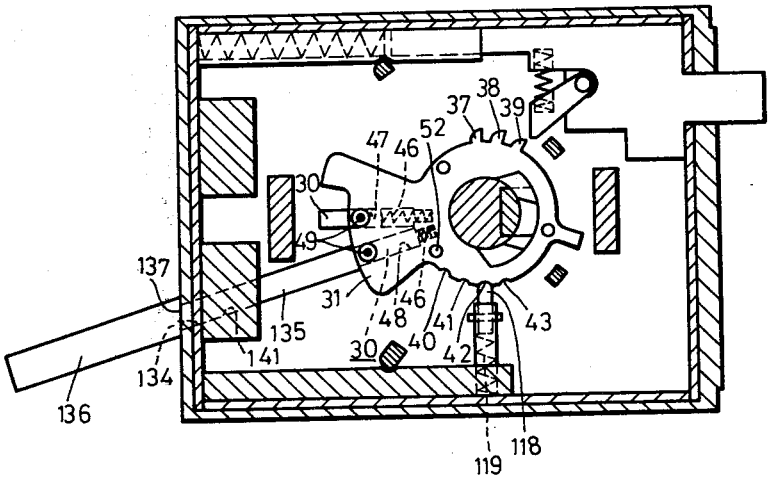
Figure 24:
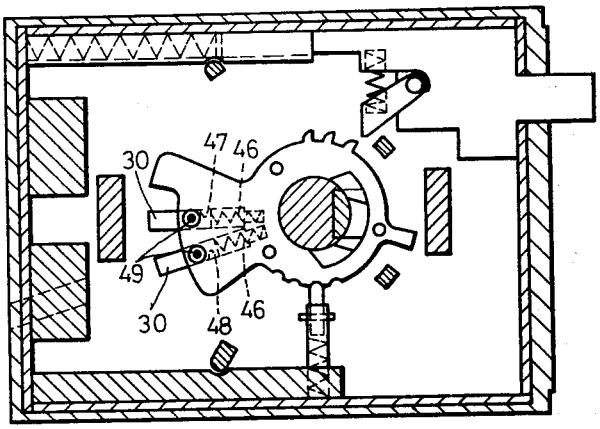
Figure 25:
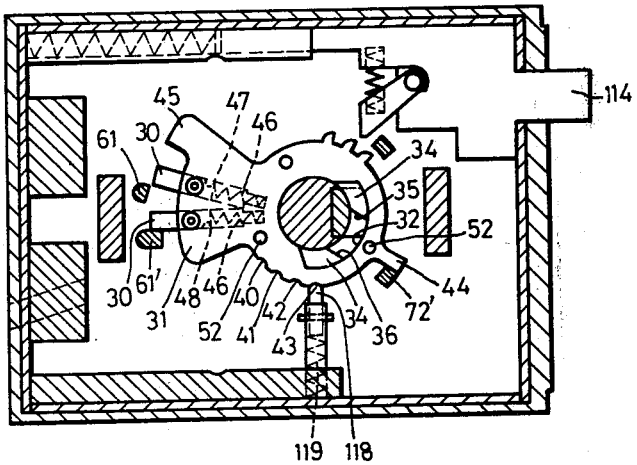
FIG. 25 is a view similar to FIG. 24, but illustrating the various parts in a different operational position.
Figure 26:
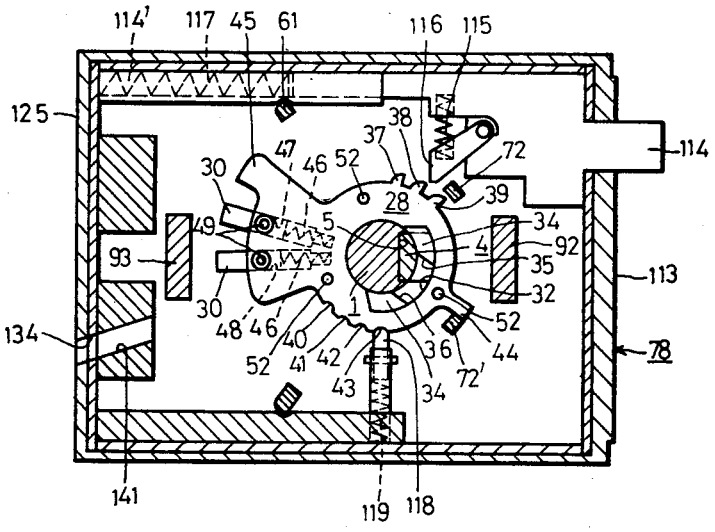
FIG. 26 is a vertical sectional view taken along the line XXVI—XXVI of FIG. 1.

In its position shown in FIG. 20, the "4" tumbler ring 28 has its second lateral bore 48 axially aligned with the "4" aperture 134 of the rear end wall 125. In this position of the "4" tumbler ring 28, the guide rod 135 is inserted through the "4" aperture 134 until the inclined end face 137 of its handle extension 136 contacts the exterior surface of the rear end wall 125 as shown in FIG. 23, whereby the engage pin 30 is totally concealed in the lateral bore 48 of the "4" tumbler ring 28 with the stop pin 49 received in the second recess 54 on the engage pin 30. Upon withdrawal of the guide rod 135 at this moment, the engage pin 30 is retracted outwardly as the stop pin 49 moves into the first recess 53, so that the engage pin 30 projects to the extent that it functionally takes the place of the finger 45 on the tumbler ring 28 as shown in FIG. 24. The pushbutton 126 is depressed again to rotate the locking rings 58 and 58', along with the driving rods 61 and 61', in a manner similar to that which has already been described. The driving rod 61' engages the engage pin 30 projecting from the lateral bore 48 of the "4" tumbler ring 28 and the "4" tumbler ring 28 is rotated by a predetermined angle as shown in FIG. 25. The pushbutton 126 is released and the locking rings 58 and 58', along with the driving rods, return to their original positions under the action of the springs 124 and 124'. The "4" tumbler ring 28, however, remains in its rotated position with the positioning pin 118 engaged in the peripheral recess 43 of the "4" tumbler ring 28 as shown in FIG. 26.

The door lock is now in its operative position in which the "1" and "7" tumbler rings 28 and 28' have each been rotated by a predetermined angle, while the "4" tumbler ring 28 has been rotated twice by a predetermined angle each time. The tongues 35, 35' and 35 of the three tumbler rings are engaged in the notches 79, 82 and 85, respectively, of the lock bolt 4, whereby the lock bolt 4 is fixed or held longitudinally immovable. The remaining seven tumbler rings 28 and 28' stay in their respective original, inoperative positions. Thus, the "1" and "7" pushbuttons 114 operationally related to the "1" and "7" tumbler rings 28 and 28', respectively, are each set for a single time of depression and the "4" pushbutton 114 operationally associated with the "4" tumbler ring 28 are set for twice repeated depression to cooperate with the "1" and "7" pushbuttons 114 to open the door lock in which the code number "1744" has been inputted.

Figure 28:
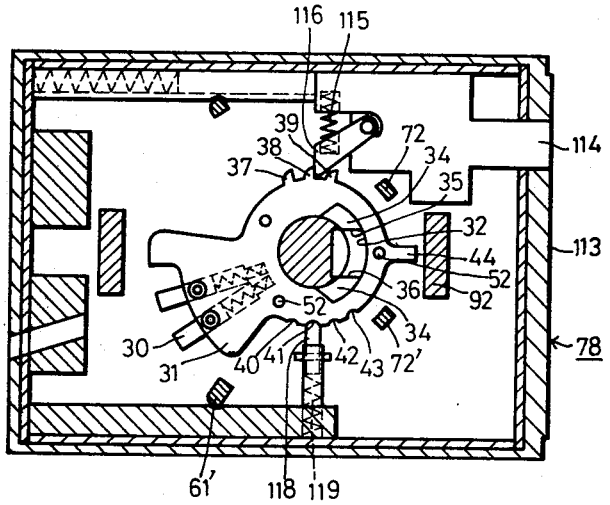
FIGS. 27 through 29 are views similar to FIG. 26, but illustrating the various parts in different operational positions.
Figure 27:
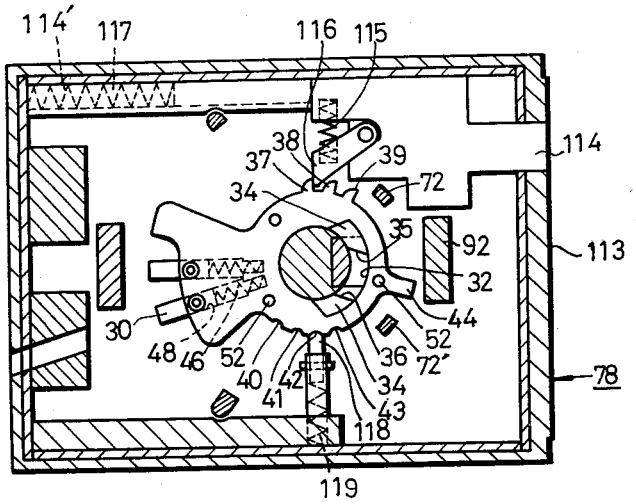
Figure 29:
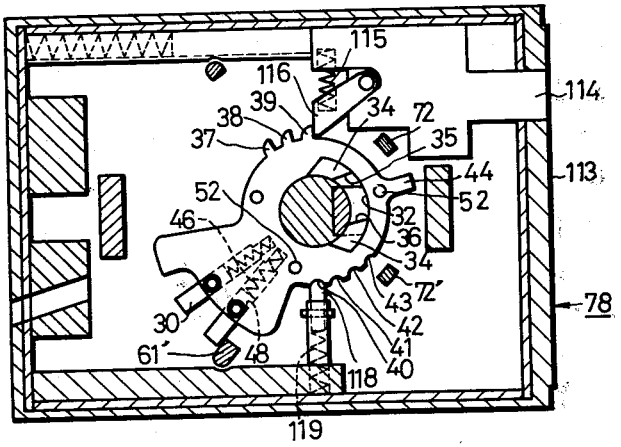

In order to open the door lock on the outdoor side of a door or the like in which the front end wall 113 is usually positioned, the selected pushbuttons 114 may be depressed a predetermined number of times. When the "1" and "7" pushbuttons 114 are each depressed once against the action of the spring 117, the pawl member 116 on the "1" pushbutton 114 engages the ratchet 38 on the "1" tumbler ring 28 and rotates the "1" tumbler ring 28 by a predetermined angle; likewise, the pawl member 116 on the "7" pushbutton 114 engages the ratchet 38' on the "7" tumbler ring 28' and rotates the "7" tumbler ring 28' by the same predetermined angle. Thus, the "1" tumbler ring 28 and the "7" tumbler ring 28' are moved from their position shown in FIG. 20 to the position of FIG. 21. When the "4" pushbutton 114 is depressed twice against the action of the spring 117, the pawl member 116 on the "4" pushbutton 114 engages first the ratchet 37 on the "4" tumbler ring 28 as shown in FIG. 27 and then the ratchet 38 as shown in FIG. 28, whereby the "4" tumbler ring 28 is rotated twice by a predetermined angle each time. Thus, the "4" tumbler ring 28 is progressively moved from its position shown in FIG. 26, through the position of FIG. 27, to the position of FIG. 28. Thus, the recessed openings 32, 32' and 32 of the "1", "7" and "4" tumbler rings are aligned with the guide opening 12 of the end plate 11 and their tongues 35, 35' and 35 are disengaged from the notches 79, 82 and 85, respectively, of the lock bolt 4. The "1", "7" and "4" tumbler rings are maintained in their respective rotated positions already described with the three corresponding positioning pins 118 engaged in the peripheral recesses 41, 41' and 41, respectively, of the three tumbler rings. Then, the lever 94 is rotated counterclockwise as viewed in FIG. 6. The teeth 95 on the lever 94 are progressively engaged with the tooth receiving apertures 96 of the front leg portion 92 of the propelling member 90, whereby the propelling member 90 is retracted to thereby retract the lock bolt 4 inwardly until the magnet 100 on the end portion 97 of the propelling member 90 contacts the iron piece 143 on the interior surface of the side wall 142 of the casing 78, whereupon the lock bolt 4 is totally concealed in the casing 78. The door lock is, thus, opened or released from its locked position.

Figure 13:
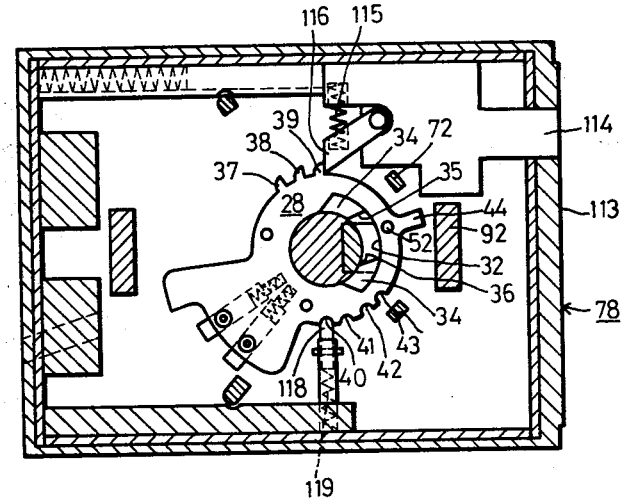
FIGS. 13 to 15 are views similar to FIG. 12, but illustrating the various parts in different operational positions.
Figure 18:
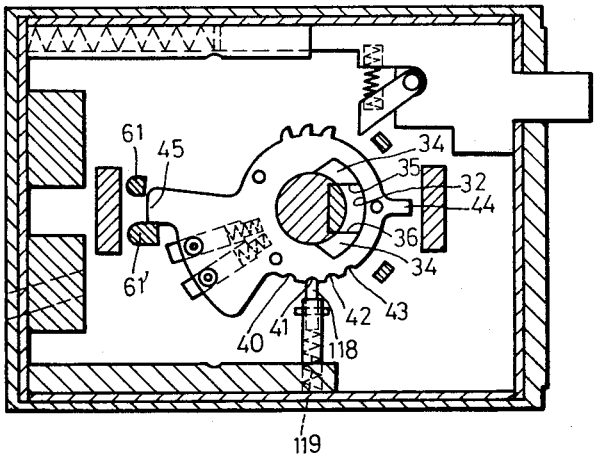
Figure 21:
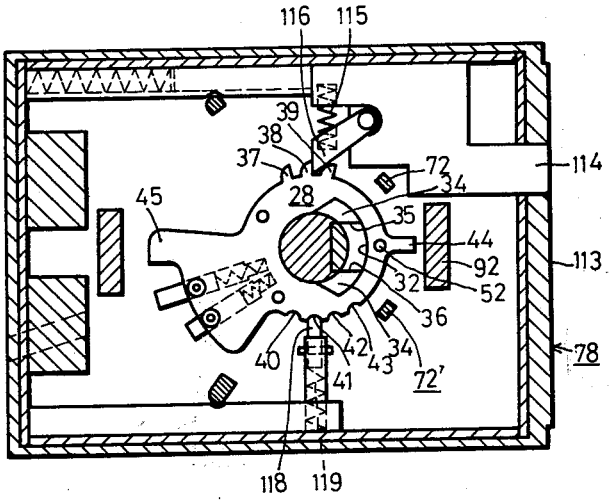
FIGS. 21 through 24 are views similar to FIG. 20, but illustrating the various parts in different operational positions.
Figure 22:
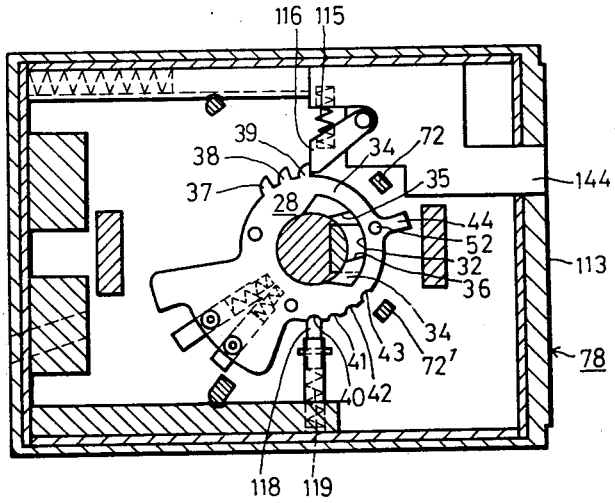

If by mistake, any other pushbutton 114 not selected to formulate the code number, for example, the "3" pushbutton 114 is depressed against the action of the spring 117, the corresponding "3" tumbler ring 28 is rotated by a predetermined angle by engagement of the pawl member 116 with the ratchet 39 as shown in FIGS. 12 and 13 and the tongue 36 on the "3" tumbler ring 28 is engaged in the notch 83 of the lock bolt 4, whereby the lock bolt 4 is more rigidly fixed in place. The same thing will happen if any of the selected pushbuttons 114 is depressed more or less often than necessary. If, for example, the "1" pushbutton 114 set for single depression is erroneously depressed twice, the corresponding "1" tumbler ring 28 is further rotated by a predetermined angle by engagement of the pawl member 116 with the ratchet 39 as shown in FIGS. 20, 21 and 22 and the tongue 36 on the "1" tumbler ring 28 is engaged in the notch 79 of the lock bolt 4, whereby the lock bolt 4 is more rigidly fixed in place. Likewise, if the "4" pushbutton 114 set for double depression is depressed only once, the tongue 35 on the corresponding "4" tumbling ring 28 remains engaged in the notch 85 of the lock bolt 4 as shown in FIGS. 26 and 27; therefore, the door lock cannot be opened. If the "4" pushbutton 114 is depressed three times, the pawl member 116 on the "4" pushbutton 114 will engage the ratchet 39 on the "4" tumbler ring 28 and rotate the "4" tumbler ring 28 further by a predetermined angle, whereby the tongue 36 on the "4" tumbler ring 28 will engage in the notch 85 of the lock bolt 4 to thereby fix the lock bolt 4 in place more rigidly. In order now to restore the door lock into its correctly operable position, it is first necessary to depress the pushbutton 120 and move it from its position shown in FIG. 8 to the position of FIG. 16, so that the fingers 121 and 122 of the pushbutton 120 engaging the ratchets 64 and 64' on the first and second locking rings 58 and 58', respectively, cause the locking rings 58 and 58' to rotate together by an angular distance equal to three times as large as the predetermined angle against the action of the springs 124 and 124'. Consequently, the driving rod 61' engages the finger 45 on the "3" tumbler ring 28 as shown in FIG. 18, the engage pin 30 projecting from the lateral bore 47 of the "1" tumbler ring 28 as shown in FIG. 19 and the engage pin 30 projecting from the lateral bore 48 of the "4" tumbler ring 28 as shown in FIG. 25, whereby the "3", "1", and "4" tumbler rings 28 are rotated back into their respective original positions. The pushbuttons 120 is then released and returns to its original position under the action of the springs 123, whereby the locking rings 58 and 58', along with the driving rods 61 and 61', return to their original positions under the action of the springs 124 and 124'. The "3", "1" and "4" tumbler rings 28 will, however, remain in their respective rotated positions with the positioning pins 118 engaged in their respective peripheral recesses 41, 42 and 43 as shown in FIGS. 18, 19 and 25, respectively. The door lock can now be opened if its pushbutton operation is correctly effected as hereinbefore described.

Figure 16:
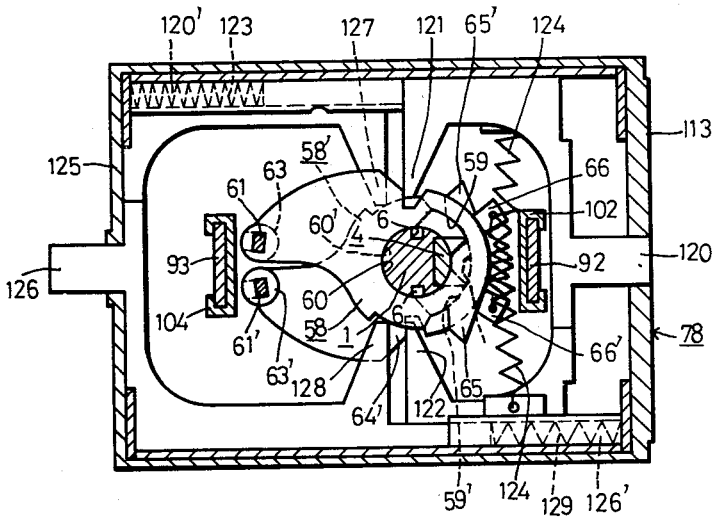
FIGS. 16 through 19 are views similar to FIG. 8, but illustrating the various parts in different operational positions.

When a man standing in front of the front end wall 113 of the door lock wishes to open the door lock, he rotates the front lever 94 clockwise as viewed in FIG. 6 to allow its teeth 95 to be progressively engaged in the tooth receiving apertures 96 on the front leg portion 92 of the propelling member 90. Thus, the propelling member 90, along with the lock bolt 4 carried thereon, is advanced until the magnet 100 on the end portion 97 contacts the iron piece 15 on the end plate 11 with the lock bolt 4 projecting outwardly from the casing 78 as shown in FIG. 6. Then, the pushbutton 120 is depressed, and its fingers 121 and 122 engaging the ratchets 64 and 64' of the locking rings 58 and 58', respectively, urge the locking rings 58 and 58', along with the driving rods 61 and 61' carried thereon, to rotate about the lock shaft 1 together by an angular distance equal to three times as large as the predetermined angle against the action of the springs 124 and 124' as shown in FIGS. 6, 8 and 16. The driving rod 61' engages the engage pin 30 projecting from the lateral bore 47 of the "1" tumbler ring 28 as shown in FIG. 19 and the engage pin 30 projecting from the lateral bore 48 of the "4" tumbler ring 28 as shown in FIG. 25. Likewise, the driving rod 61 engages the engage pin 30 projecting from the lateral bore 47' of the "7" tumbler ring 28'. Thus, the "1" tumbler ring 28 and the "7" tumbler ring 28' are both rotated by the predetermined angle and the "4" tumbler ring 28 is rotated by an angular distance equal to twice as large as the predetermined angle. The pushbutton 120 is, then, released and returns to its original position under the action of the springs 123 and the locking rings 58 and 58', along with the driving rods 61 and 61', return to their respective original positions under the action of the springs 124 and 124'. The "1" tumbler ring 28, "4" tumbler ring 28 and "7" tumbler ring 28' will, however, remain in their respective rotated positions with the positioning pins 118 engaged in their respective peripheral recesses 42, 43 and 42'. The tongues 35, 35 and 35' of the "1", "4" and "7" tumbler rings, respectively, become thus engaged in the corresponding notches 79, 85 and 82 of the lock bolt 4, whereby the lock bolt 4 is held in its outwardly projecting position. In this position of the lock bolt 4, its extension 4' is adapted to be received in a bolt receiving hole formed on a door frame, whereby the door is locked.

Attention is now directed to the mode of operation on the indoor side of the door on which the door lock of this invention is mounted. In order to open the door lock, the pushbutton 111 on the rear end wall 125 is depressed and moved from its position shown in FIG. 9 to the position of FIG. 30. The finger 130 of the pushbutton 111 engaging the ratchet 75 of the first unlocking ring 69 urges the unlocking ring 69 to rotate along with the driving rod 72 against the action of the spring 133.

Figure 33:
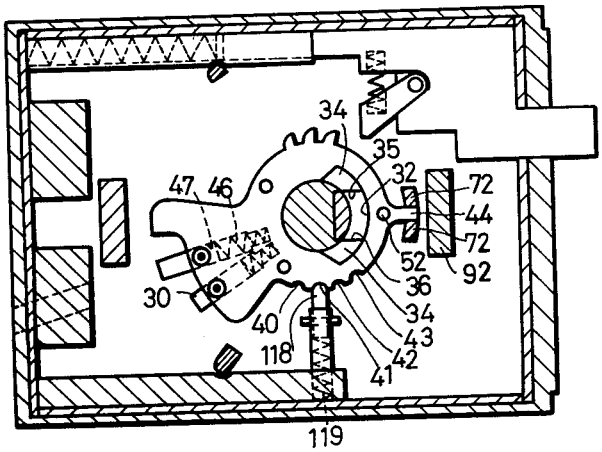
Figure 32:
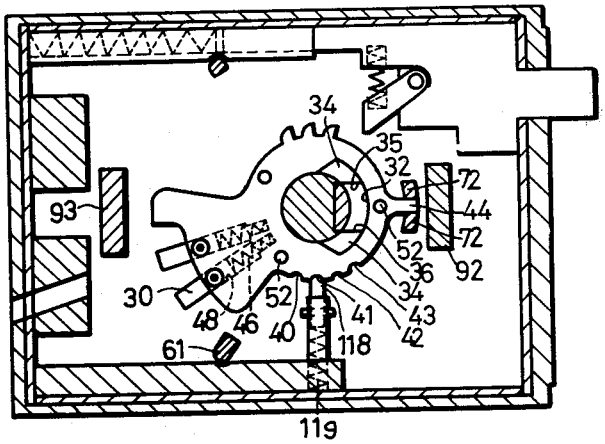

Likewise, the other finger 131 of the pushbutton 111 engaging the ratchet 75' of the second unlocking ring 69' urges the unlocking ring 69' to rotate along with the driving rod 72' against the action of the spring 133'. Thus, the unlocking rings 69 and 69' are simultaneously rotated by an angular distance equal to twice as large as a predetermined angle. Consequently, the driving rod 72' engages the finger 44 on the "1" tumbler ring 28 as shown in FIGS. 20 and 33 and the finger 44 on the "4" tumbler ring 28 as shown in FIGS. 26 and 32, while the driving rod 72 engages the finger 44' on the "7" tumbler ring 28', whereby the "1", "4" and "7" tumbler rings are all rotated until their respective fingers 44, 44 and 44' are brought into alignment in a horizontal plane extending through the longitudinal axis of the lock shaft 1 and their respective recessed openings 32, 32 and 32' are all aligned with the guide opening 12 of the end plate 11. Then, the pushbutton 111 is released from pressure and allowed to return to its original position shown in FIG. 9 under the action of the springs 132, and the unlocking rings 69 and 69', along with the driving rods 72 and 72' carried thereon, return to their original positions under the action of the springs 133 and 133'. The "1" tumbler ring 28, "4" tumbler ring 28 and "7" tumbler ring 28' will, however, remain in their rotated positions with the positioning pins 118 engaged in their respective peripheral recesses 41, 41 and 41' and with their respective recessed openings 32, 32 and 32' all remaining aligned with the guide opening of the end plate 11, while their tongues 35, 35 and 35' are disengaged from the notches 79, 85 and 82, respectively, of the lock bolt 4. Then, the rear lever 94' is rotated clockwise as viewed in FIG. 6 to engage its teeth 95' progressively with the tooth receiving apertures 96' on the rear leg portion 93 of the propelling member 90, whereby the propelling member 90 is retracted toward the side wall 142 of the casing 78 until the magnet 100 on its end portion 97 contacts the iron piece 143 on the side wall 142. Consequently, the lock bolt 4 is retracted and its locking extension 4' is totally concealed or retracted into the casing 78, whereupon the door lock is released from its locking position relative to the door.

In order to place the door lock in its locked position by manipulation on the indoor side of the door, the rear lever 94' is rotated counterclockwise as viewed in FIG. 6 to advance the propelling member 90 or move it away from the side wall 142 until the magnet 100 contacts the iron piece 15 on the end plate 11 as shown in FIG. 6, whereby the locking extension 4' on the lock bolt 4 projects outwardly from the casing 78 into the bolt receiving hole in the door frame not shown. Then, the pushbutton 126 is depressed and moved from its position shown in FIG. 8 to the position of FIG. 17. All in a manner similar to that which has already been described, the fingers 127 and 128 of the pushbutton 126 engaging the ratchets 65' and 65 of the locking rings 58' and 58, respectively, urge the locking rings 58' and 58 to rotate about the lock shaft 1 along with the driving rods 61' and 61 against the action of the springs 124' and 124 as shown in FIGS. 8 and 17. The driving rod 61' engages the engage pin 30 projecting from the lateral bore 47 of the "1" tumbler ring 28 as shown in FIG. 19 and the engage pin 30 projecting from the lateral bore 48 of the "4" tumbler ring 28 as shown in FIG. 25. Likewise, the driving rod 61 engages the engage pin 30 projecting from the lateral bore 47' of the "7" tumbler ring 28'. Thus, the "1" tumbler ring 28 and the "7" tumbler ring 28' are both rotated by the predetermined angle and the "4" tumbler ring 28 is rotated by an angular distance equal to twice as large as the predetermined angle. Then, the pushbutton 126 is released from pressure and allowed to return to its original position shown in FIG. 8 under the action of the springs 129, and the locking rings 58 and 58', along with the driving rods 61 and 61', return to their original positions under the action of the springs 124 and 124'. The "1", "4", and "7" tumbler rings will, however, remain in their respective rotated positions with the positioning pins 118 engaged in their respective peripheral recesses 42, 43 and 42', whereby the tongues 35, 35 and 35' on the "1", "4" and "7" tumbler rings engage in the notches 79, 85 and 82, respectively, of the lock bolt 4 to thereby hold the lock bolt 4 in its outwardly projecting position and lock the door to the door frame.

Figure 34:
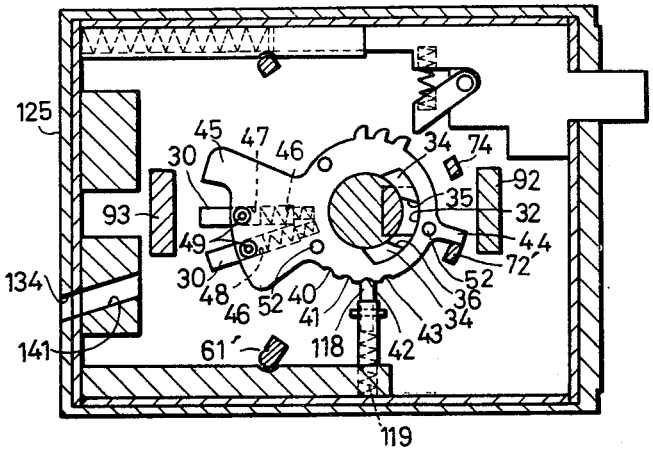

When it is desired to change the code number inputted into the door lock of this invention, it is first necessary to cancel the old code number. With the door lock maintained in its closed position, the adaptor 144 is inserted over the pushbutton 111 and the pushbutton 111 is depressed as shown in FIG. 31. The fingers 130 and 131 of the pushbutton 111 engaging the ratchets 75 and 75' of the unlocking rings 69 and 69' urge the unlocking rings 69 and 69' to rotate, along with the respective driving rods 72 and 72', against the action of the springs 133 and 133'. But the unlocking rings 69 and 69' can now rotate only an angular distance equal to the predetermined angle, rather than twice as large as that as previously described, because the depth of depression of the pushbutton 111 is restricted to a half by the adaptor 144. As the result, the driving rod 72' engaging the finger 44 of the "4" tumbler ring 28 for twice repeated operation causes the "4" tumbler ring 28 to rotate only by an angular distance equal to the predetermined angle as shown in FIGS. 26 and 34. The pushbutton 111 is released from depression to return to its initial position under the action of the springs 132, whereby the unlocking rings 69 and 69' also return to their initial positions under the action of the springs 133 and 133', together with the driving rods 72 and 72'. Although the driving rod 72' thus moves away from engagement with the finger 44 of the "4" tumbler ring 28, the "4" tumbler ring 28 will remain in its rotated position with the positioning pin 118 engaged in its peripheral recess 42, so that the engage pin 30 projecting from the lateral bore 48 of the "4" tumbler ring 28 is axially aligned with the "4" aperture 134 in the rear wall 125, as shown in FIG. 34. The second guide rod 138 is then inserted through the aperture 134 until the inclined end face 140 of its handle extension 139 contacts the exterior surface of the rear end wall 125 as shown in FIG. 35. The guide rod 138 abuts on the outer end of the engage pin 30 and pushes it into the lateral bore 48 of the tumbler ring 28 against the action of the spring 46 as the stationary stop pin 49 moves relative to the engage pin 30 away from the first recess 53 and along the first groove 55. Since the second guide rod 138 is smaller in length than the first guide rod 135 as stated before, however, the relative movement f the stop pin 49 to the engage pin 30 is such that the stop pin 49 fails to reach the second recess 54 on the engage pin 30, but stops in front of the third recess 57 as shown in FIG. 67. The guide rod 138 is then pulled out of the casing, whereby the engage pin 30, which has been released from application of force by the guide rod 138, is moved outwardly under the action of the spring 46 and the stop pin 49 slides into the third recess 57. In other words, the engage pin 30 is moved from its position shown in FIG. 66 to its position shown in FIG. 68, in which the engage pin 30 is concealed in the lateral bore 48 along the greater part of its length and the position of the "4" tumbler ring 28 is now equal to that of the "1" tumbler ring 28 shown in FIG. 20 for single pushbutton operation.

Then, the adaptor 144 is removed and the pushbutton 111 is depressed again. Its fingers 130 and 131 engaging the ratchets 75 and 75' of the unlocking rings 69 and 69' cause the unlocking rings 69 and 69' to rotate, along with the respective driving rods 72 and 72', simultaneously as shown in FIGS. 9 and 30. The driving rod 72' on the second unlocking ring 69' engages the fingers 44 on the "1" and "4" tumbler rings 28, respectively, while the driving rod 72 on the first unlocking ring 69 engages the finger 44' on the "7" tumbler ring 28', whereby the fingers 44 and 44' on the three tumbler rings are rotated into horizontal alignment with one another in a horizontal plane extending centrally across the door lock as is obvious from FIG. 33. Depression of the pushbutton 111 is then discontinued. While this allows the unlocking rings 69 and 69' to return to their initial positions along with the driving rods 72 and 72', the "1" tumbler ring 28, the "4" tumbler ring 28 and the "7" tumbler ring 28' will remain in their rotated position as the positioning pins 118 hold them by their engagement with the peripheral recesses 41 and 41' of the respective tumbler rings. The lateral bores 47 and 47' of the "1", "4" and "7" tumbler rings are now axially aligned with the "1" aperture 134, "4" aperture 134 and "7" aperture 134', respectively, of the rear end wall 125. Then, the second guide rod 138 is inserted through each of the "1", "4" and "7" apertures 134 and 134' until the inclined end face 140 of its handle extension 139 contacts the exterior surface of the rear end wall 125 as shown in FIG. 36. In each case of guide rod insertion, the guide rod 138 abuts on the outer end of the engae pin 30 and pushes it into the lateral bore 47 against the action of the spring 46 with the movement of the stop pin 49 relative to the engage pin 30. The stop pin 49 leaves the first recess 53 on the engage pin 30 and slides along the first groove 55 to permit rotation of the engage pin 30 about its own axis during its inward movement relative to the lateral bore 47. As the second guide rod 138 is smaller in length than the first guide rod 135, however, it can push the engage pin 30 inwardly only to the extent that the stop pin 49 stops in front of the third recess 57 without traveling through the entire length of the first groove 55 and reaching the second recess 54, as shown in FIG. 67. Therefore, upon removal of the guide rod 138, the engage pin 30 moves outwardly to some extent until the stop pin 49 slips into the third recess 57 under the action of the spring 46. The engage pin 30 is now concealed in the lateral bore 47 along the greater part of its length as best shown in FIG. 68 and all of the "1", "4", and "7" tumbler rings 28 and28' that have been adapted for operation by a single depression of the corresponding pushbuttons are brought back to their respective inoperative positions as shown in FIGS. 12 and 10. The recessed opening 32 or 32' of each of these three tumbler rings is aligned with the guide opening 12 in the end plate 11, whereby the lock bolt 4 is released from any interference by any tumbler ring and freely movable along the guide groove 5 on the lock shaft 1. The old code number is thus canceled and the door lock is now ready for inputting any new code number as desired in accordance with the sequence which has hereinbefore been described by way of example.

Although the invention has been described with reference to a preferred embodiment thereof, it is to be understood that modifications or variations may easily be made of those skilled in the art without departing from the spirit and scope of this invention as defined by the appended claims.

What I claim is:

1. A pushbutton operated door lock comprising:

a casing having a wall;

a lock shaft in said casing;

a lock bolt slidably supported on said lock shaft and having a plurality of notches juxtaposed along the length of said lock bolt;

a plurality of tumbler rings rotatably supported on said lock shaft and juxtaposed along the length thereof, each of said tumbler rings having an outer peripheral edge formed with a plurality of lateral bores;

a plurality of engage pins each having one end received in one of said lateral bores of each of said tumbler rings and reciprocatorily movable along said one lateral bore for restricting an angle of rotation of said each tumbler ring;

a plurality of first pushbuttons on said casing adapted to rotate said tumbler rings individually;

a plurality of second pushbuttons on said casing adapted to rotate said tumbler rings simultaneously;

said wall of said casing having a portion formed therethrough with a plurality of apertures each providing access to said engage pin in any of said lateral bores of one of said tumbler rings for the reciprocatory movement of said engage pin for restricting said angle of rotation of said tumbler ring on the outside of said casing; and each of said notches being engageable with one of said tumbler rings upon rotation of said one tumbler ring.

2. A pushbutton operated door lock as defined in claim 1, further including a stop pin extending into each of said lateral bores of each of said tumbler rings, and a compression spring placed in each of said lateral bores and resting against said one end of said engage pin, each of said engage pins having a cylindrical peripheral surface formed with a pair of inclined grooves extending in opposite directions along said cylindrical peripheral surface, each of said grooves having one end closer to said one end of said engage pin than to another end thereof and another end closer to said other end of said engage pin, said one end of one of said grooves being connected with said one end of the other groove to define a first recess therebetween which is closer to said one end of said engage pin than said one end of said each groove is, said other end of said one groove being connected with said other end of said other groove to define therebetween a second recess which is closer to said other end of said enage pin than said other end of said each groove is, said one groove being approximately twice as large in length as said other groove, said cylindrical surface further having a third recess connected with said one groove and positioned closer to said second recess than to said first recess, said third recess being located on the opposite side of said one groove from said second recess, said stop pin being movable relative to said grooves and recesses to rotate said engage pin for said reciprocatory movement of said engage pin against and under the action of said spring upon application of force onto said other end of said engage pin and its release therefrom when said stop pin is positioned in one of said first and third recesses.

3. A pushbutton operated door lock as defined in claim 2, further including a first pusher rod and a second pusher rod which is somewhat smaller in length than said first pusher rod, said first pusher rod being adapted for insertion into said casing through any of said apertures and engagement with said other end of one of said engage pins to push said one engage pin against the action of said spring and rotate it about its axis with the movement of said stop pin along said one groove to said second recess to thereby conceal said engage pin totally in said one lateral bore, said engage pin being adapted, upon withdrawal of said first pusher rod from said aperture, to project from said lateral bore under the action of said spring with further rotation of said engage pin about its axis by the movement of said stop pin relative to said other groove until said stop pin reaches said first recess, whereby said engage pin is exposed from said lateral bore along the greater part of its length, said second pusher rod being adapted for insertion into said casing through any of said apertures and engagement with said other end of one of said engage pins to push said one engage pin against the action of said spring and rotate it about its axis with the movement of said stop pin along said one groove to a position in front of said third recess, said engage pin being adapted, upon withdrawal of said second pusher rod from said aperture, to project from said lateral bore under the action of said spring with the movement of said stop pin into said third recess, whereby said engage pin is concealed in said lateral bore along the greater part of its length.

4. A pushbutton operated door lock as defined in claim 3, further including locking and unlocking ring means having driving rod means rigidly secured thereto and adapted upon depression of said second pushbuttons to engage said tumbler rings to rotate all of said tumbler rings simultaneously about said lock shaft.

5. A pushbutton operated door lock as defined in claim 4, wherein said outer peripheral edge of each of said tumbler rings is further formed with a plurality of recesses juxtaposed along said edge, said door lock further including a plurality of positioning pins resiliently supported in said casing and each of which is engageable selectively with any of said recesses of one of said tumbler rings to maintain said one tumbler ring in a selected rotated position.

6. A pushbutton operated door lock as defined in claim 5, further including a plurality of markings carried on another portion of said wall of said casing and formed by different alphabetical letters, of which at least one is located adjacent to each of said first pushbuttons.

* * * * *